US007651256B2

(12) United States Patent
Lee et al.

(10) Patent No.: US 7,651,256 B2
(45) Date of Patent: Jan. 26, 2010

(54) VENTILATION/ILLUMINATION DUCT, VENTILATION/ILLUMINATION SYSTEM USING THE VENTILATION/ILLUMINATION DUCT, AND CONTROL METHOD FOR THE VENTILATION/ILLUMINATION SYSTEM

(75) Inventors: Ju Youn Lee, Seoul (KR); Kyung Hwan Kim, Uiwang-si (KR); Ho Jung Kim, Incheon (KR); Kwan ho Yum, Seoul (KR); Ho Seon Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 102 days.

(21) Appl. No.: 11/419,340

(22) Filed: May 19, 2006

(65) Prior Publication Data

US 2006/0264167 A1 Nov. 23, 2006

(30) Foreign Application Priority Data

May 20, 2005 (KR) ..... 10-2005-0042498

(51) Int. Cl.
*F21V 5/00* (2006.01)

(52) U.S. Cl. ..... 362/580; 362/373; 362/582; 362/583; 362/218; 454/296

(58) Field of Classification Search ..... 362/580, 362/373, 582, 583, 218, 1
See application file for complete search history.

(56) References Cited

U.S. PATENT DOCUMENTS 5,217,000 A * 6/1993 Pierce-Bjorklund ..... 126/621
5,681,218 A * 10/1997 Kishi et al. ..... 454/75
6,142,645 A * 11/2000 Han ..... 362/147
6,224,248 B1 * 5/2001 Chiba ..... 362/580
6,922,228 B2 * 7/2005 Chou et al. ..... 349/161
2003/0000230 A1 * 1/2003 Kopko ..... 62/82
2003/0147261 A1 * 8/2003 Babbitt et al. ..... 362/582
2004/0013583 A1 * 1/2004 Burkhardt ..... 422/186.3

FOREIGN PATENT DOCUMENTS

CN 1465882 1/2004
JP 2003-50044 2/2003

OTHER PUBLICATIONS

English Language Abstract of JP 2003-50044.
English Language Abstract of CN 1465882.
U.S. Appl. No. 11/383,833 to Keun Hyoung Choi et al., filed May 17, 2006.

* cited by examiner

*Primary Examiner*—Sandra L O'Shea
*Assistant Examiner*—Jessica L McMillan
(74) *Attorney, Agent, or Firm*—McKenna Long & Aldridge LLP

(57) ABSTRACT

A ventilation/illumination duct is disclosed which can not only ventilate an indoor space, but also can illuminate the indoor space. A ventilation/illumination system using the ventilation/illumination duct, and a control method for the ventilation/illumination system are also disclosed. The ventilation/illumination system includes a ventilation device for blowing air, a light supplying device for supplying light, a ventilation/illumination duct for not only guiding the air blown by the ventilation device, to ventilate an indoor space, but also totally reflecting the light, to illuminate an indoor space, and a cleaner arranged in the ventilation/illumination duct.

29 Claims, 16 Drawing Sheets

VENTILATION/ILLUMINATION DUCT, VENTILATION/ILLUMINATION SYSTEM USING THE VENTILATION/ILLUMINATION DUCT, AND CONTROL METHOD FOR THE VENTILATION/ILLUMINATION SYSTEM

This application claims the benefit of Korean Patent Application No. P05-42498, filed on May 20, 2005, which is hereby incorporated by reference as if fully set forth herein.

BACKGROUND OF THE INVENTION

1. Field of the Invention

The present invention relates to a ventilation/illumination duct which can not only ventilate a confined space, for example, an indoor space, but also can illuminate the indoor space. The present invention also relates to a ventilation/illumination system using the ventilation/illumination duct, and a control method for the ventilation/illumination system.

2. Discussion of the Related Art

Typically, various ventilation devices and various illumination devices are installed in general houses, large buildings, and factories, in order to ventilate confined spaces, and to provide a certain level of illumination to the confined spaces.

Ventilation devices include a duct for defining a flow passage of air, and a fan unit for sucking outdoor, air into the duct, and discharging indoor air out of the duct. Such a ventilation device may also include a total heat exchanger for recovering a portion of heat energy contained in indoor air.

Meanwhile, illumination devices include lamps electrically connected to electric wires, and adapted to artificially illuminate a confined space. Recently, an optical pipe has been used as an illumination device, to illuminate an indoor space and/or an outdoor space at a certain level. The optical pipe has advantages in that the optical pipe not only reduces loss of light generated from a lamp during propagation of the light because the optical pipe totally reflects the light, but also incurs no generation of heat, and thus, results in no or little danger of fire.

However, the above-mentioned conventional illumination devices and ventilation devices have the following problems.

First, since it is necessary to provide separate spaces for an illumination device and a ventilation device in an indoor space, in conventional cases, there are problems in that the space for installing such facilities in the indoor space is increased, and electric wiring becomes complex. In particular, when an optical pipe is used as the illumination device, the optical pipe should be arranged on the ceiling, independently of a duct of the ventilation device. For this reason, there are problems of an increase in installation space, and considerable difficulty in installation and design.

Second, although the optical pipe and duct should be arranged at most appropriate positions for efficient illumination and ventilation, respectively, the positions may be overlapped with each other. In this case, there is a problem in that one of the illumination and ventilation efficiencies must be reduced because the associated optical pipe or duct should be installed at a position other than the most appropriate position.

Third, the conventional optical pipe is configured to illuminate an indoor space using a separate lamp. However, the lamp is always in an ON state thereof, irrespective of the weather conditions, to illuminate indoor space. For this reason, there is a problem of a considerable increase in power consumption.

SUMMARY OF THE INVENTION

Accordingly, the present invention is directed to a ventilation/illumination duct, a ventilation/illumination system using the ventilation/illumination duct, and a control method for the ventilation/illumination system that substantially obviate one or more problems due to limitations and disadvantages of the related art.

An object of the present invention is to provide a ventilation system having an illumination function which can simultaneously perform illumination and ventilation operations, thereby being capable of achieving a reduction in installation space, easy installation, and a simplified installation design, and a control method for the system.

Another object of the present invention is to provide a ventilation system having an illumination function which can enhance illumination and ventilation efficiencies, and a control method for the system.

Another object of the present invention is to provide a ventilation system having an illumination function which can achieve a reduction in power consumption, and a control method for the system.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a ventilation/illumination system comprises: a ventilation device for blowing air; a light supplying device for supplying light; a ventilation/illumination duct for not only guiding the air blown by the ventilation device, to ventilate an indoor space, but also totally reflecting the light, to illuminate an indoor space; and a cleaner arranged in the ventilation/illumination duct.

In another aspect of the present invention, a ventilation/illumination system comprises: a ventilation device for blowing air; a light supplying device for supplying light; and a ventilation/illumination duct including an air guide connected to the ventilation device, and adapted to guide the air blown by the ventilation device, and a light guide arranged such that the light guide is independent of the air guide, the light guide being connected to the light providing device, and functioning to totally reflect the light, to enable the light to illuminate an indoor space.

In another aspect of the present invention, a method for controlling a ventilation/illumination system comprises the steps of: selectively operating the sunlight concentrator or artificial light generator, to supply light; measuring an illuminance of the supplied light; measuring an illuminance of the light after the light is totally reflected in a ventilation/illumination duct included in the ventilation/illumination system; calculating a difference between the measured illumination of the supplied light and the measured illumination of the totally-reflected light; and operating a cleaner when the calculated illumination difference is not less than a predetermined value, to clean the ventilation/illumination duct.

In another aspect of the present invention, a method for controlling a ventilation/illumination system comprises the steps of: summing an operating time of a ventilation device included in the ventilation/illumination system; determining whether or not the summed operating time has reached a predetermined time; and operating a cleaner when it is determined that the summed operating time has reached the predetermined time, to clean a ventilation/illumination duct included in the ventilation/illumination system.

In still another aspect of the present invention, a ventilation/illumination duct comprises: an air guide for forming an air passage; and a light guide formed such that the light guide is independent of the air guide, the light guide guiding light to be outwardly irradiated from the light guide after being totally reflected.

It is to be understood that both the foregoing general description and the following detailed description of the present invention are exemplary and explanatory and, are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention associated with a drying apparatus, examples of which are illustrated in the accompanying drawings. Wherever possible, the same reference numbers will be used throughout the drawings to refer to the same or like parts.

Figure 1:
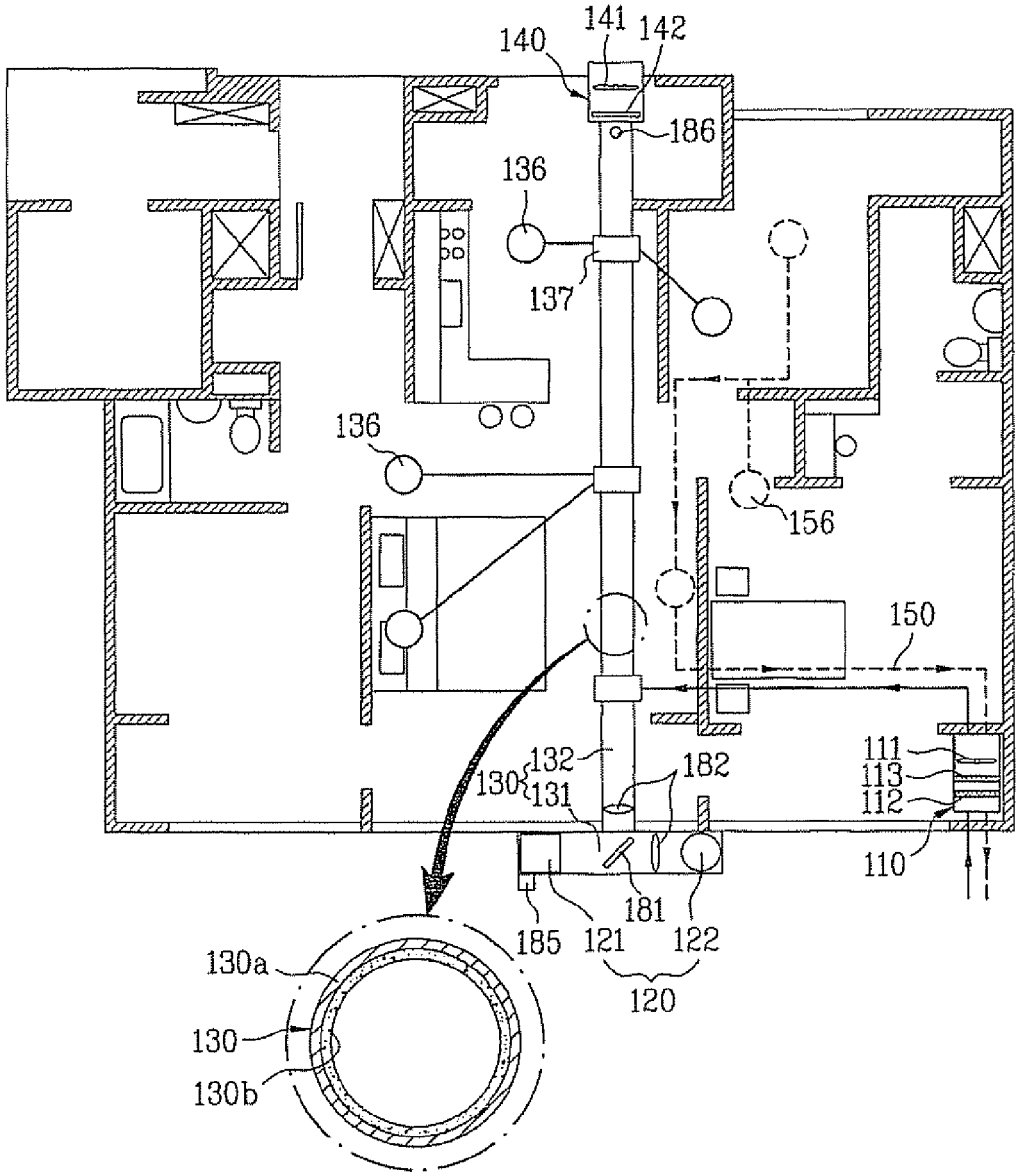
FIG. 1 is a schematic plan view illustrating a configuration of a ventilation/illumination system according to a first embodiment of the present invention.
Figure 2:
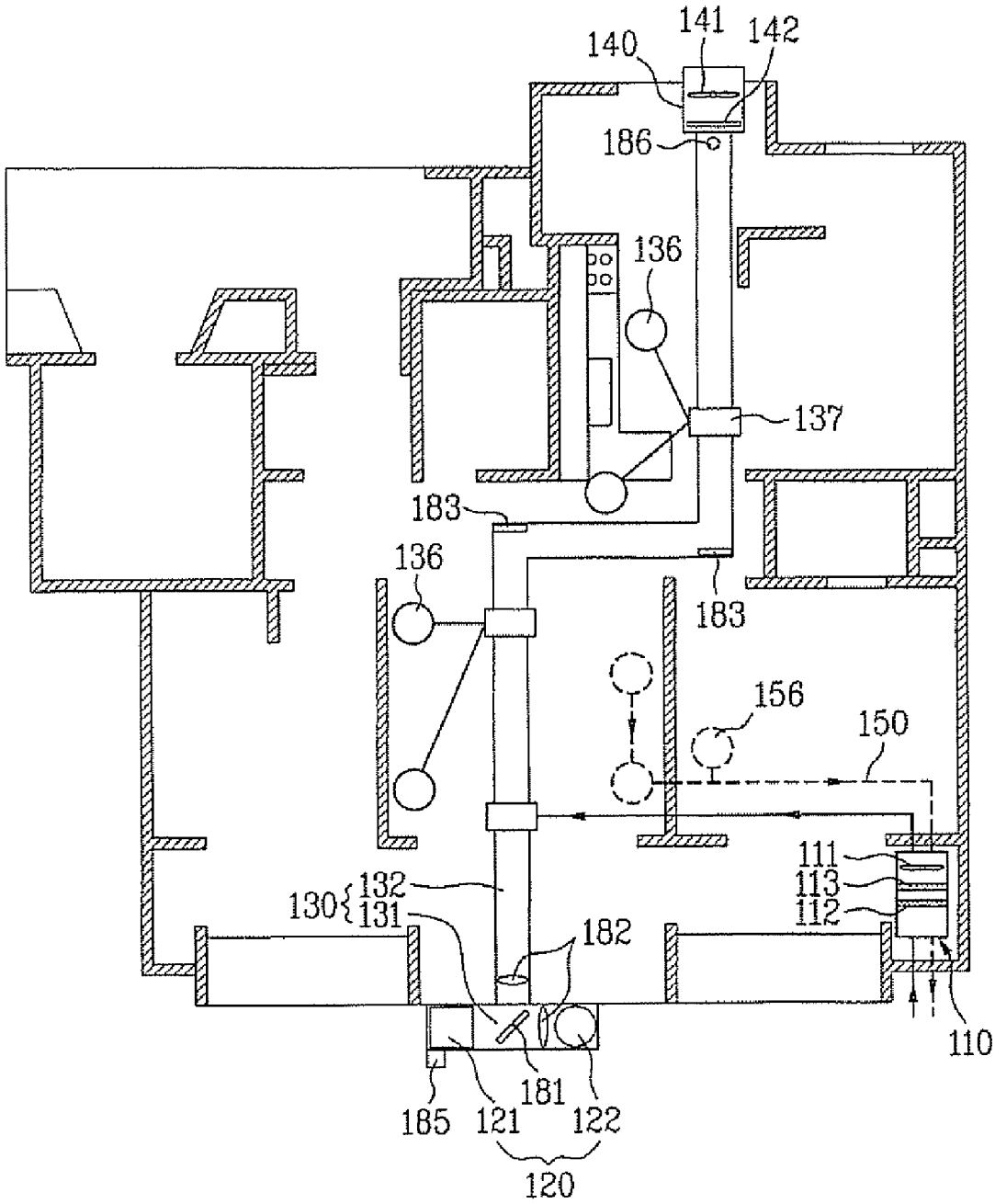
FIG. 2 is a schematic plan view illustrating a modification of the ventilation/illumination system shown in FIG. 1.

First, a ventilation system having an illumination function (hereinafter, referred to as a "ventilation/illumination system") according to a first embodiment of the present invention will be described with reference to FIGS. 1 and 2. In FIGS. 1 and 2, a line, through which air is supplied, is indicated by a solid line, whereas a line, through which air is discharged, is indicated by a broken line. Also, the flow direction of air is indicated by arrows, for better understanding thereof.

The ventilation/illumination system includes a ventilation device 110 for blowing outdoor air, and a light supplying device 120 for supplying light. The ventilation/illumination system also includes an illumination/air supply duct 130 for not only guiding the outdoor air blown by the ventilation device 110, to ventilate an indoor space, but also guiding light such that the light travels along the illumination/air supply duct 130 while being totally reflected, to illuminate an indoor space. The ventilation/illumination system further includes an air supply duct cleaner 140 arranged in the illumination/air supply duct 130.

The ventilation device 110 includes a fan unit 111 for sucking indoor air/ outdoor air, and a total heat exchanger (not shown) for causing indoor air and outdoor air to heat-exchange with each other, thereby recovering thermal energy from the indoor air and outdoor air. The fan unit 111 includes an air supply fan for supplying outdoor air to an indoor space, and an air discharge fan for discharging indoor air to the outdoors. Of course, a single fan, which has both an air supply function and an air discharge function, may be applied to the fan unit. The illumination/air supply duct 130 is connected to the ventilation device 110. Air supplying diffusers 136 are connected to the illumination/air supply duct 130. Preferably, an air discharge duct 150 for discharging indoor air to the outdoors is connected to the ventilation device 110. Air discharging diffusers 156 are connected to the air discharge duct 150. Preferably, a filter 112 is also arranged in the illumination/air supply duct 130, in order to filter outdoor air, and thus, to enable filtered air to be supplied to the illumination/air supply duct 130. Accordingly, it is possible to prevent a contaminant such as dust contained in outdoor air from being introduced into the illumination/air supply duct 130, and into the indoor space. In particular, when the contaminant is introduced into the illumination/air supply duct 130, and is attached to an optical total reflection film 130*b* included in the illumination/air supply duct 130, a degradation in the optical total reflection efficiency of the optical total reflection film 130*b* occurs. Also, it will be appreciated that a deodorizing filter 113 may be installed in the ventilation device 110, in order to deodorize outdoor air.

The illumination/air supply duct 130 may have a rectilinear structure as shown in FIG. 1, or may have a bent structure as shown in FIG. 2. Where the illumination/air supply duct 130 has a bent structure, it is preferred that mirrors 183 be arranged at bent portions of the illumination/air supply duct 130, in order to reflect light in desired directions, respectively.

The constituent elements shown in FIG. 2 are identical to those of FIG. 1, except for the mirrors 183. Accordingly, the same constituent elements in FIGS. 1 and 2 are designated by the same reference numerals, respectively.

The illumination/air supply duct 130 is constituted by two or more optical pipes, adjacent ones of which are connected by a connector 137. Preferably, each air supplying diffuser 136 is connected to the associated connector 137 via a connecting pipe.

As shown in FIG. 1, the illumination/air supply duct 130 includes an acrylic tube 130*a*, in addition to the optical total reflection film 130*b*. The optical total reflection film is attached to an inner surface of the acrylic tube 130*a*.

Meanwhile, the light supplying device 120 includes a sunlight concentrator 121 arranged in the illumination/air supply duct 130, and adapted to supply concentrated sunlight, and an artificial light generator 122 arranged in the illumination/air supply duct 130, and adapted to supply artificial light.

Figure 3:
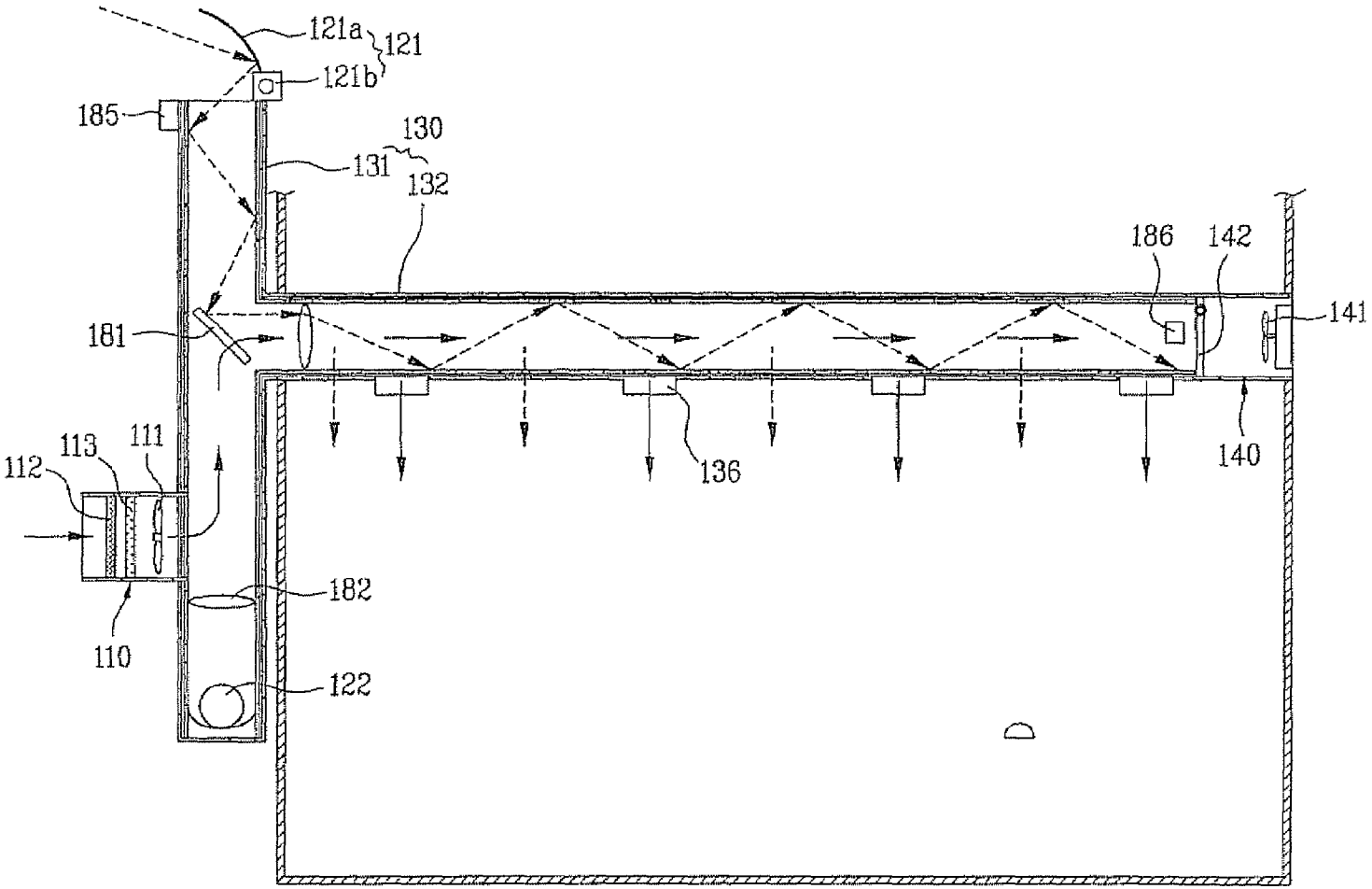
FIG. 3 is a schematic sectional view illustrating a sunlight illumination mode and an air supply operation of the ventilation/illumination system shown in FIG. 1.

It is preferred that the sunlight concentrator 121 be rotatable in accordance with the altitude of the sun, in order to efficiently concentrate sunlight to the illumination/air supply duct 130. As shown in FIG. 3, the sunlight concentrator 121 includes a light concentrating plate 121*a* for concentrating sunlight to the interior of the illumination/air supply duct 130, and a motor 121*b* for rotating the light concentrating plate 121*a*. Although the light supplying device 120 is illustrated as including one sunlight concentrator 121 directed in one of the sunrise and sunset directions, sunlight concentrators 121 may be arranged to be directed in both the sunrise and sunset directions, respectively. In either case, the light supplying device 120 may include a plurality of sunlight concentrators 121.

The artificial light generator 122 is constituted by a lamp adapted to generate artificial light, using a very high frequency (VHF) discharge. The VHF discharge lamp has advantages of a long life span, a substantially constant lumen maintenance for the life span, and a reduced variation in lumen efficacy. For such a VHF discharge lamp, a metal halide lamp, a sulfur lamp, or an optical cavity lamp may be used.

The illumination/air supply duct 130 includes a first air supply duct 131 connected to the ventilation device 110, and adapted to guide light and outdoor air, and a second air supply duct 132 connected to the first air supply duct 131, and arranged in the indoor space. The second air supply duct 132 functions to guide light and outdoor air such that the light and outdoor air are supplied to the indoor space.

Preferably, the sunlight concentrator 121 and artificial light generator 122 are arranged in the first air supply duct 131.

The first air supply duct 131 may be arranged at the outdoors, or may be embedded in a wall of a building in which the ventilation/illumination system is installed.

Where the first air supply duct 131 is arranged at the outdoors, it is preferred that light in the first air supply duct 131 be prevented from being outwardly leaked from the first air supply duct 131. For example, when the first air supply duct 131 is made of acrylic resin allowing light to be transmitted therethrough, a separate light shield duct (not shown) is arranged around the first air supply duct 131. Of course, the first air supply duct 131 may be made of a material preventing light from being transmitted therethrough. In this case, it is unnecessary to install a separate light shield duct around the first air supply duct 131. Using such an arrangement, it is possible to prevent light from being outwardly leaked at night, and thus, to avoid adverse affects on the ecosystem.

The optical total reflection film 130*b* extends along the inner surfaces of the first and second air supply ducts 131 and 132 such that the optical total reflection-film 130*b* surrounds an air flow passage defined in the illumination/air supply duct 130 along the first and second air supply ducts 131 and 132. Thus, each of the first and second air supply ducts 131 and 132 is constituted by a corresponding portion of the acrylic tube 130*a*, and a corresponding portion of the optical total reflection film 130*b* attached to the inner surface of the acrylic tube 130*a*. Accordingly, each of the inner spaces of the first and second air supply ducts 131 and 132 functions as an air flow passage and a light travel path.

A rotating mirror 181 is arranged in the first air supply duct 131 at a region where the first air supply duct 131 is connected to the second air supply duct 132 such that the rotating mirror 181 reflects light from the first air supply duct 131 to the second air supply duct 132. An incidence angle adjusting lens 182 is arranged in each of the first and second air supply ducts 131 and 132, to adjust the incidence angle of light incident to the associated first or second air supply duct 131 or 132.

Preferably, a first illuminance sensor 185 is arranged in the first air supply duct 131, in order to measure the illuminance of the sunlight or artificial light supplied to the first air supply duct 131. The first illuminance sensor 185 measures the illuminance of the sunlight, and determines, based on the result of the measurement, which one of the sunlight concentrator 121 and artificial light generator 122 should be controlled.

Preferably, a second illuminance sensor 186 is also arranged inside or outside the illumination/air supply duct 130, in order to measure the illuminance of light totally reflected in the illumination/air supply duct 130. When the amount of a contaminant attached to the optical total reflection film 130*b* of the illumination/air supply duct 130 reaches a certain level, the total reflection efficiency of the optical total reflection film 130*b* is reduced to a certain level. Such a reduction in total reflection efficiency causes a decrease in the illuminance of the light traveling in the illumination/air supply duct 130 and the illuminance of the light irradiated to the indoor space after emerging from the illumination/air supply duct 130. The second illuminance sensor 186 sends information as to the measured illumination to a controller, in order to enable the controller to determine whether or not the air supply duct cleaner 140 should operate.

Meanwhile, it is preferred that the air supply duct cleaner 140 be arranged at an end of the illumination/air supply duct 130. Of course, it will be appreciated that the air supply duct cleaner 140 may be arranged at any appropriate position in the illumination/air supply duct 130.

The air supply duct cleaner 140 includes a fan-unit 141 for discharging a contaminant from the illumination/air supply duct 130 to the outdoors, along with air, and a cleaning damper 142 for opening or closing the end of the illumination/air supply duct 130 where the air supply duct cleaner 140 is arranged.

The cleaning damper 142 may have a structure enabling the cleaning damper 142 to be hingable about a hinge shaft, or may have various structures other than the hinge structure.

Figure 4:
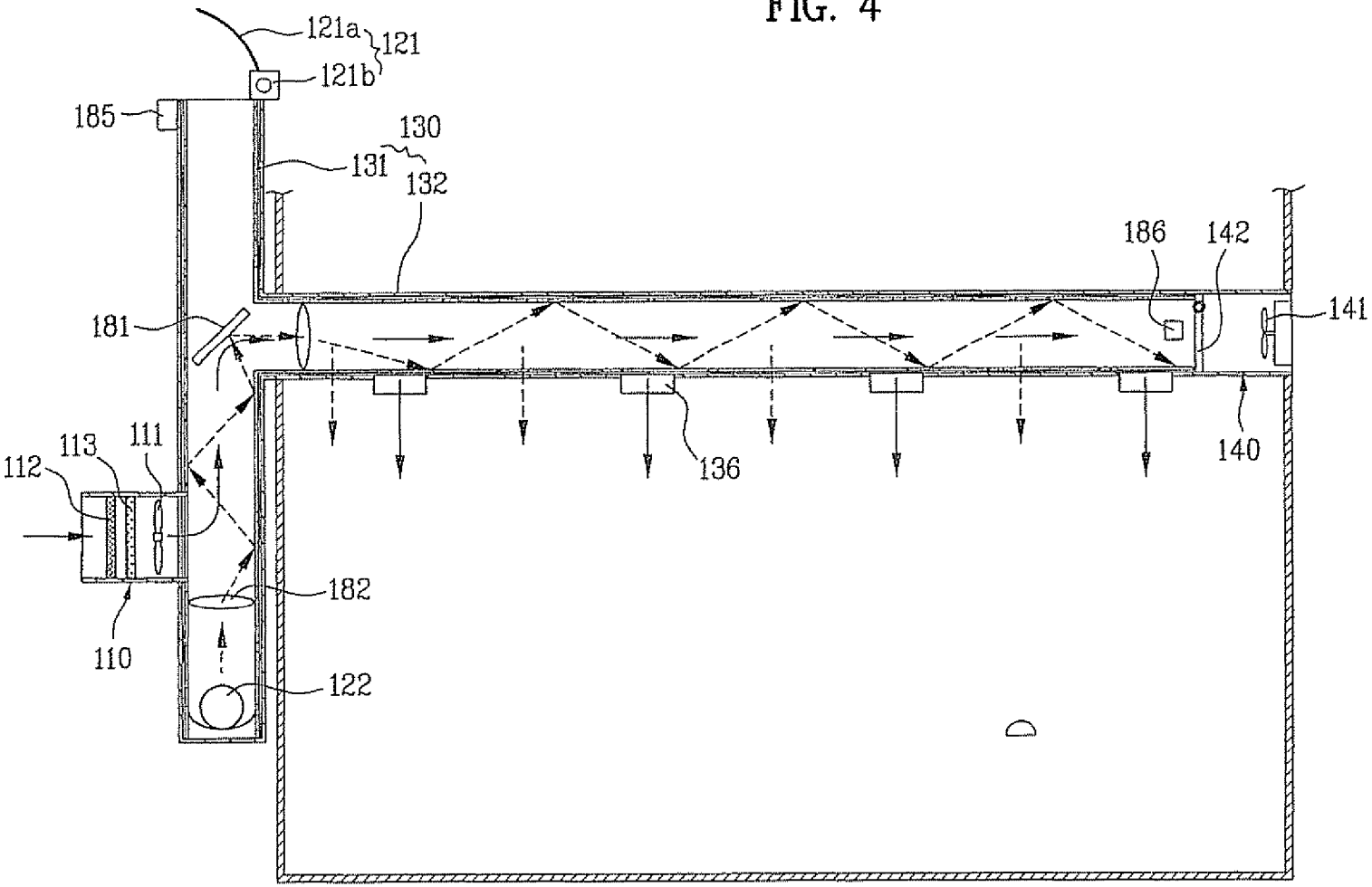
FIG. 4 is a schematic sectional view illustrating an artificial light illumination mode and an air supply operation of the ventilation/illumination system shown in FIG. 1.
Figure 5:
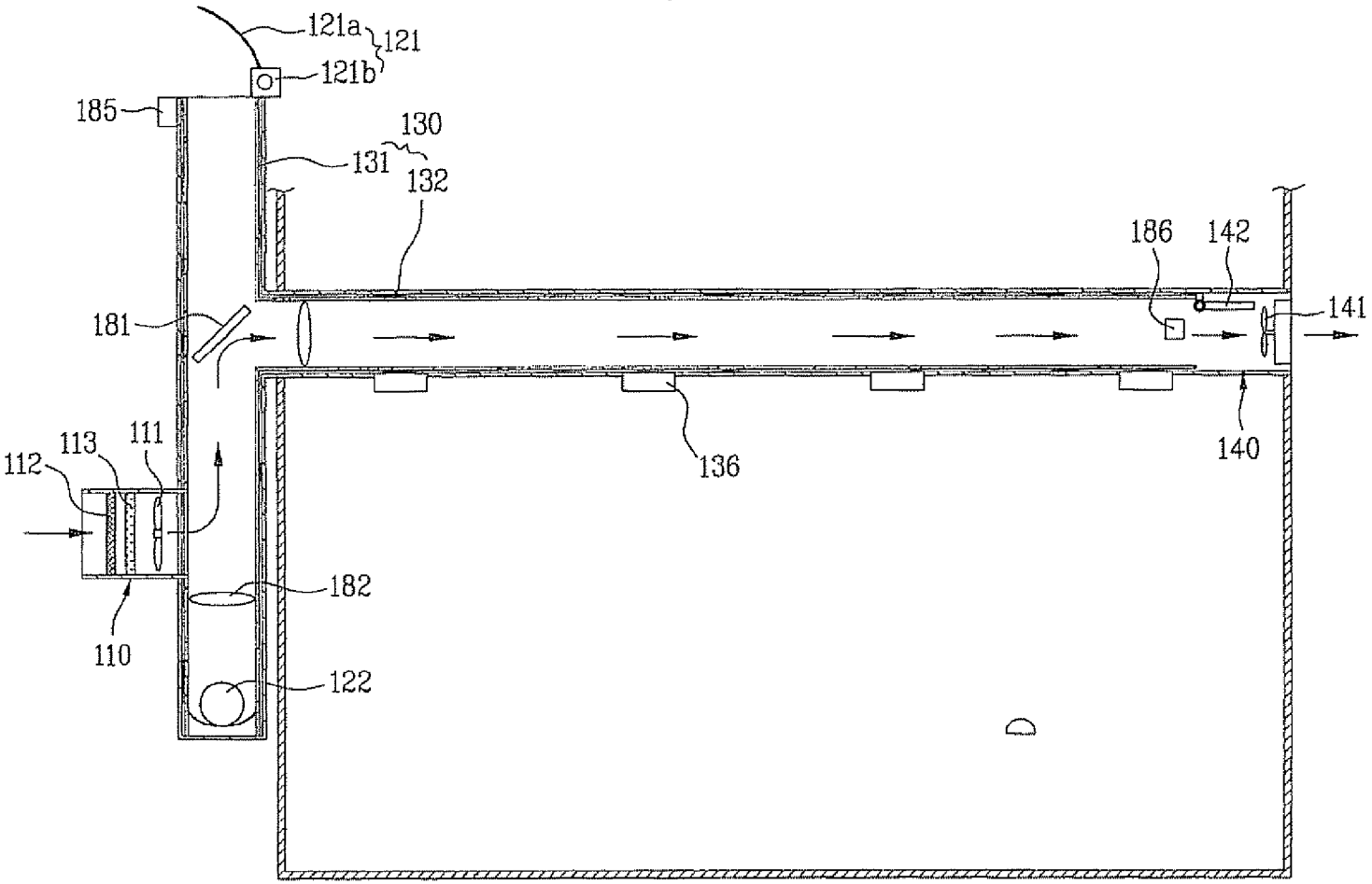
FIG. 5 is a schematic sectional view illustrating a cleaning mode of the ventilation/illumination system shown in FIG. 1.

Hereinafter, operation of the ventilation/illumination system having the above-described configuration according to the first embodiment of the present invention will be described with reference to FIGS. 3 to 5.

The ventilation/illumination system can be operated in a natural illumination mode or in an artificial illumination mode in accordance with the illuminance of sunlight- Also, each illumination mode may be carried out simultaneously with or independently of a ventilation mode. The case shown in FIGS. 3 and 4 corresponds to the case in which each illumination mode is carried out simultaneously with the ventilation mode.

First, the illumination mode of the ventilation/illumination system will be described.

The ventilation/illumination system selectively operates the sunlight concentrator 121 or the artificial light generator 122, based on information as to the illuminance of sunlight sent from the first illuminance sensor 185. Of course, the sunlight concentrator 121 and artificial light generator 122 may be selectively operated in accordance with operation of the user.

When the sunlight concentrator 121 is operated, the sunlight concentrator 121 is first rotated, in accordance with the altitude of the sun, to an angular position where the sunlight concentrator 121 can concentrate a maximum amount of sunlight to the interior of the first air supply duct 131, as shown in FIG. 3. On the other hand, when the artificial light generator 122 is operated, VHF artificial light is emitted from the artificial light generator 122, as shown in FIG. 4. The sunlight or artificial light is incident to the first air supply duct 131, and then travels along the first air supply duct 131 while being totally reflected by the optical total reflection film 130*b*.

The rotating mirror 181 in the first air supply duct 131 reflects the totally-reflected light emerging from the first air supply duct 131 to the second air supply duct 132. At this time, the rotating mirror 181 has been rotated to a position corresponding to the natural illumination mode or artificial illumination mode associated with the totally-reflected light. The light reflected by the rotating mirror 181 is incident to the second air supply duct 132 via the incidence angle adjusting lens 182 of the second air supply duct 132. The incidence light travels along the second air supply duct 132 while being totally reflected by the optical total reflection film 130*b*. During the travel thereof, the light in the second air supply duct 132 is transmitted through the second air supply duct 132, thereby illuminating the indoor space at a certain illumination level (lux).

Next, the ventilation mode of the ventilation/illumination system will be described.

When the ventilation device 110 is operated, outdoor air is introduced into the first air supply duct 131 after passing through the filters 112 and 113, and thus, being filtered. The filtered outdoor air is discharged into the indoor space via the air supplying diffusers 136 after flowing through the first and second air supply ducts 131 and 132, in this order. Thus, the indoor space is ventilated by the filtered outdoor air. Air present in the indoor space, namely, indoor air, is discharged to the outdoors via the air discharge duct 150.

When the abovedescribed ventilation mode is carried out for a prolonged period of time, a contaminant such as fine dust, which could not be removed by the filters 112 and 113, may be attached to the optical total reflection film 130*b* of the illumination/air supply duct 130, thereby causing a considerable decrease in optical total reflection efficiency. To this end, the first and second illuminance sensors 185 and 186 measure illuminance of light, and send the measured illuminances to the controller. The controller then compares a difference between the illuminances measured by the first and second illuminance sensors 185 and 186 with a predetermined range, and determines the contamination level of the illumination/air supply duct 130, based on the result of the comparison. Based on the result of the determination, the controller then determines whether or not a cleaning mode should be begun.

Figure 6:
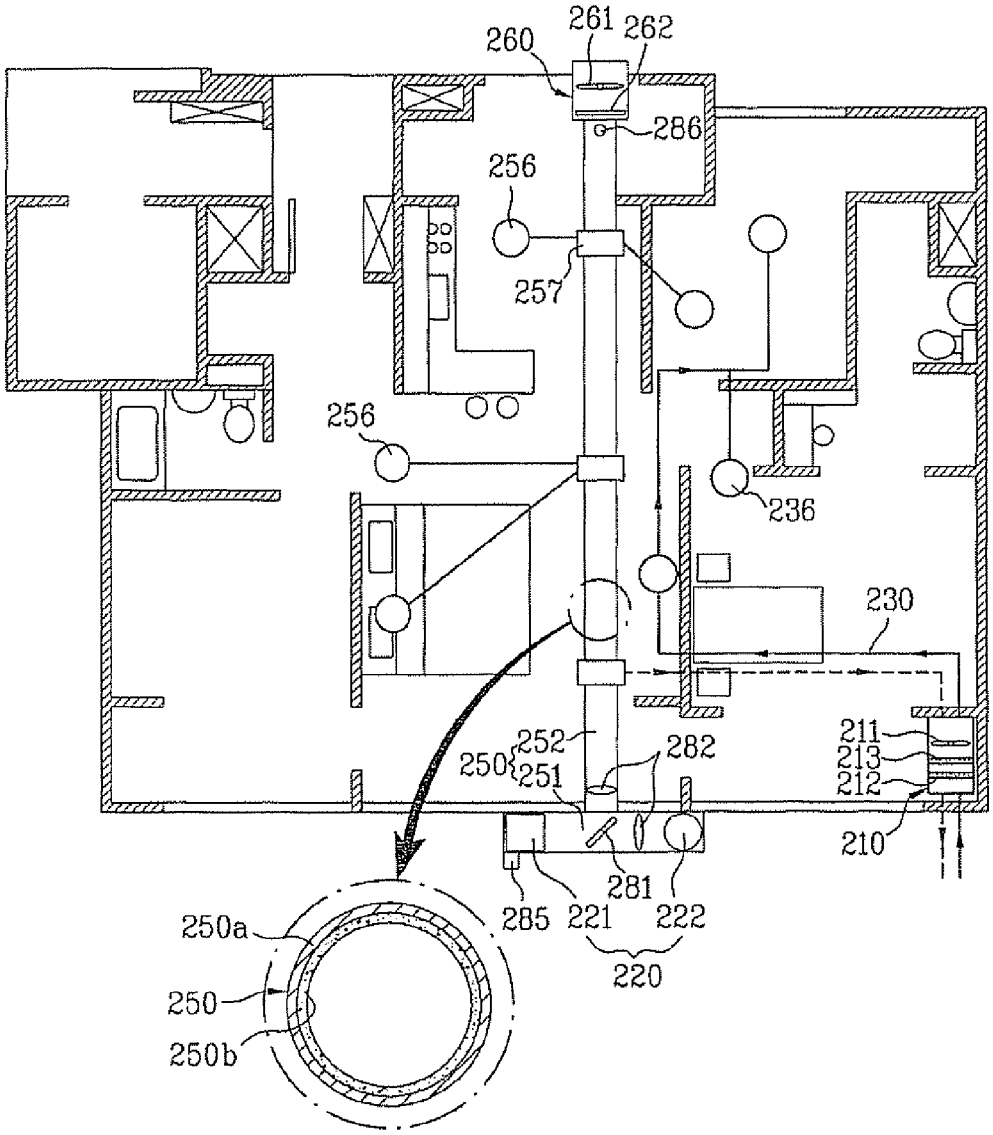
FIG. 6 is a schematic plan view illustrating a configuration of a ventilation/illumination system according to a second embodiment of the present invention.
Figure 7:
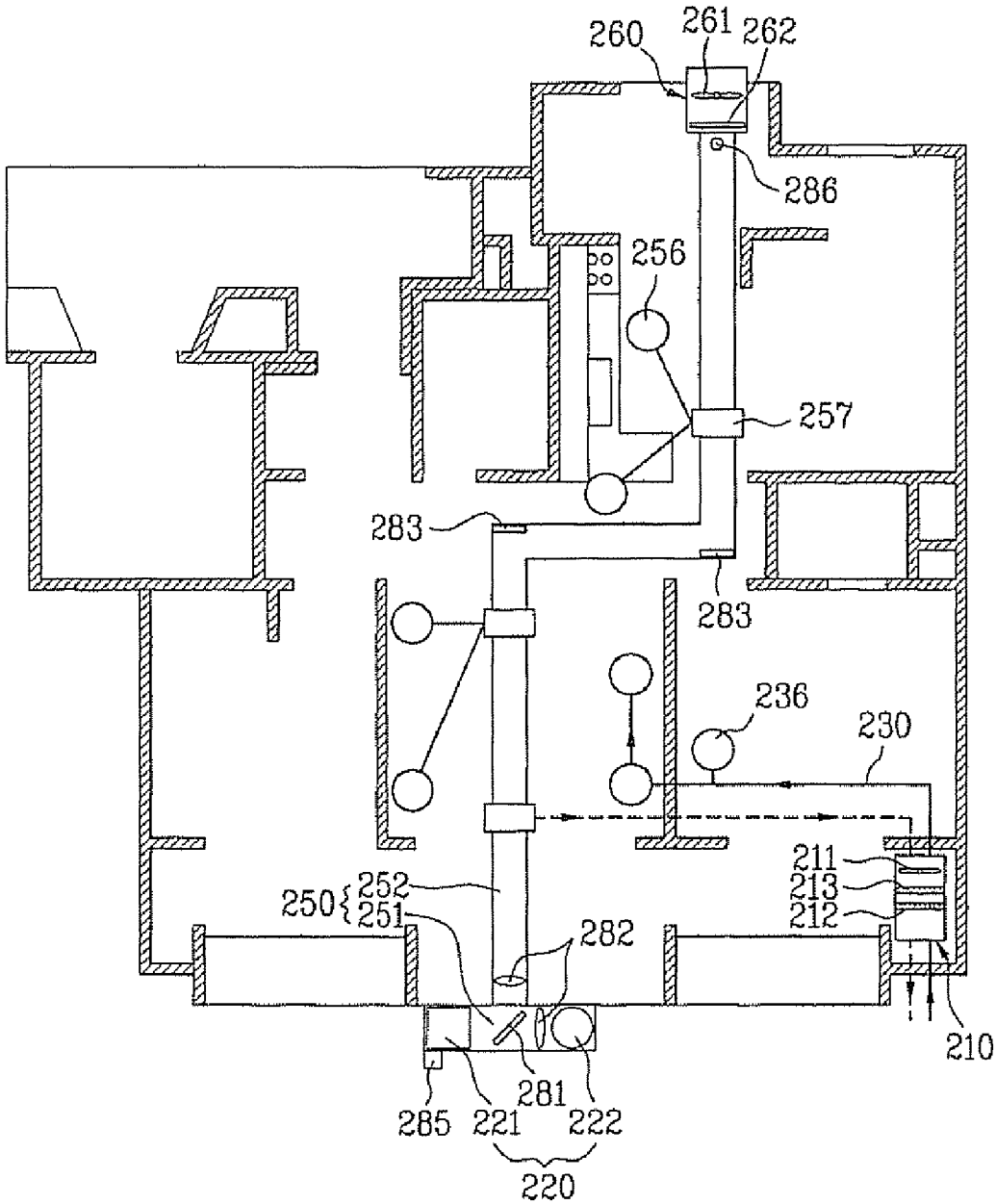
FIG. 7 is a schematic plan view illustrating a modification of the ventilation/illumination system shown in FIG. 6.

When the cleaning mode should be begun, the controller first controls the fan unit 141 to be operated. Thereafter, the controller controls the cleaning damper 142 to be opened, as shown in FIG. 5. The fan unit 141 generates a strong flow of air in the illumination/air supply duct 130, in order to detach the contaminant attached to the optical total reflection film 130*b*. At this time, the fan unit 141 generates air turbulence in the illumination/air supply duct 130, in order to more easily detach the contaminant. The fan unit 141 then sucks the detached contaminant, to discharge the sucked contaminant to the outdoors. In accordance with these operations, the illumination/air supply duct 130 is cleaned. Thus, the total reflection efficiency of the optical total reflection film 130*b* is substantially recovered, Next, a ventilation/illumination system according to a second embodiment of the present invention will be described with reference to FIGS. 6 and 7. In FIGS. 6 and 7, a line, through which air is supplied, is indicated by a solid line, whereas a line, through which air is discharged, is indicated by a broken line, Also, the flow direction of air is indicated by arrows, for better understanding thereof.

The ventilation/illumination system includes a ventilation device 210 for blowing outdoor air, and a light supplying device 220 for supplying light. The ventilation/illumination system also includes an illumination/air discharge duct 250 for not only guiding indoor air, to discharge the indoor air to the outdoors, but also guiding light such that the light travels along the illumination/air discharge duct 250 while being totally reflected, to illuminate an indoor space. The ventilation/illumination system further includes an air discharge duct cleaner 260 arranged in the illumination/air discharge duct 250.

Since the ventilation device 210 is substantially identical to that of the first embodiment, no description thereof will be given. In FIGS. 6 and 7, reference numeral 211 designates the fan unit of the ventilation device 210, and reference numerals 212 and 213 designate filters of the ventilation device 210.

The illumination/air discharge duct 250 is connected to the ventilation device 210. Air discharging diffusers 256 are connected to the illumination/air discharge duct 250. Preferably, an air supply duct 230 for supplying outdoor air to the indoor space is connected to the ventilation device 210. Air supplying diffuser 236 are connected to the air supply duct 230.

Preferably, a filter (not shown) is also arranged in the illumination/air discharge duct 250, in order to filter indoor air, and thus, to enable filtered air to be supplied to the illumination/air discharge duct 250. Accordingly, it is possible to prevent a contaminant such as dust contained in indoor air from being attached to the optical total reflection film 250*b*. As described above, when a contaminant is attached to the optical total reflection film, a degradation in the optical total reflection efficiency of the optical total reflection film 130*b* occurs. It is also preferred that filters 212 and 213 be arranged in the ventilation device 210, in order to allow outdoor air to be supplied to the air supply duct 230 after being filtered and deodorized.

The illumination/air discharge duct 250 may have a rectilinear structure as shown in FIG. 6, or may have a bent structure as shown in FIG. 7. Where the illumination/air discharge duct 250 has a bent structure, it is preferred-that mirrors 283 be arranged at bent portions of the illumination/air discharge duct 250, in order to reflect light in desired directions, respectively. The constituent elements shown in FIG. 7 are identical to those of FIG. 6, except for the mirrors 283, The illumination/air discharge duct 250 is constituted by two or more optical pipes, adjacent ones of which are connected by a connector 237. Preferably, each air discharging diffuser 256 is connected to the associated connector 237 via a connecting pipe.

Meanwhile, the light supplying device 220 includes a sunlight concentrator 221 arranged in the illumination/air discharge duct 250, and adapted to supply concentrated sunlight, and an artificial light generator 222 arranged in the illumination/air discharge duct 250, and adapted to supply artificial light.

Figure 8:
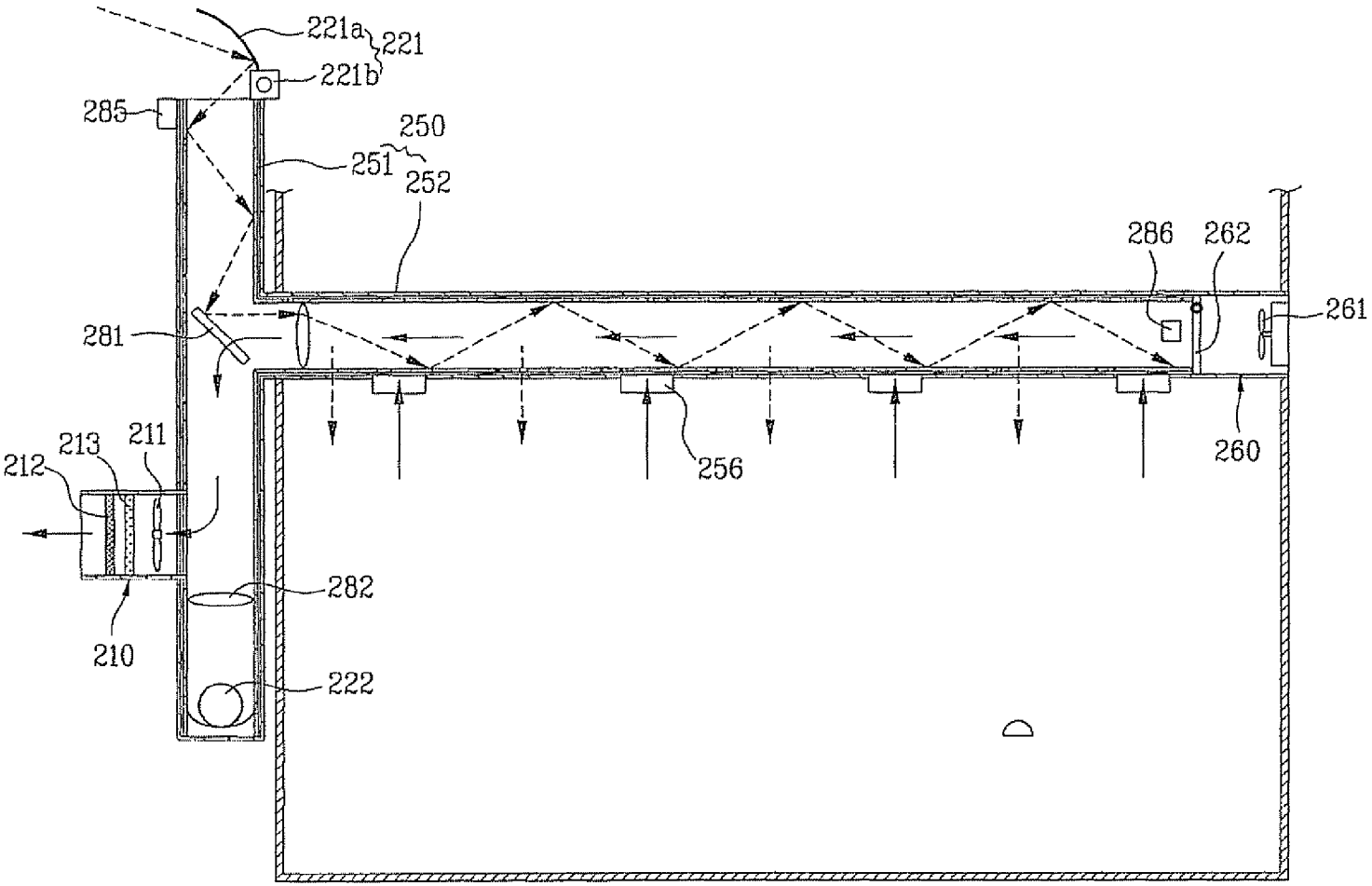
FIG. 8 is a schematic sectional view illustrating a sunlight illumination mode and an air discharge operation of the ventilation/illumination system shown in FIG. 6.

It is preferred that the sunlight concentrator 221 be rotatable in accordance with the altitude of the sun, in order to efficiently concentrate sunlight to the illumination/air discharge duct 250. As shown in FIG. 8, the sunlight concentrator 221 includes a light concentrating plate 221*a* for concentrating sunlight to the interior of the illumination/air discharge duct 250, and a motor 221*b* for rotating the light concentrating plate 221*a*. Although the light supplying device 220 is illustrated as including one sunlight concentrator 221 directed in one of the sunrise and sunset directions, sunlight concentrators 221 may be arranged to be directed in both the sunrise and sunset directions, respectively. In either case, the light supplying device 220 may include a plurality of sunlight concentrators 221.

The artificial light generator 222 is constituted by a lamp adapted to generate artificial light, using a very high frequency (VHF) discharge. Since the artificial light generator 222 is substantially identical to that of the first embodiment, no description thereof will be given.

The illumination/air discharge duct 250 includes a first air discharge duct 251 connected to the ventilation device 210, and adapted to guide light and to discharge indoor air to the outdoors, and a second air discharge duct 252 connected to the first air discharge duct 251, and arranged in the indoor space. The second air discharge duct 252 functions to discharge indoor air into the first air discharge duct 251.

The first air discharge duct 251 may be arranged at the outdoors, or may be embedded in a wall of a building in which the ventilation/illumination system is installed.

Where the first air discharge duct 251 is arranged at the outdoors, it is preferred that light in the first air discharge duct 251 be prevented from being outwardly leaked from the first air discharge duct 251. For example, when the first air discharge duct 251 is made of acrylic resin allowing light to be transmitted therethrough, a separate light shield duct (not shown) is arranged around the first air discharge duct 251. Of course, the first air discharge duct 251 may be made of a material preventing light from being transmitted therethrough. In this case, it is unnecessary to install a separate light shield duct around the first air discharge duct 251.

The optical total reflection film 250*b* extends along the inner surfaces of the first and second air discharge ducts 251 and 252 such that the optical total reflection film 250*b* surrounds an air flow passage defined in the illumination/air discharge duct 250 along the first and second air discharge ducts 251 and 252. Thus, each of the first and second air discharge ducts 251 and 252 is constituted by a corresponding portion of the acrylic tube 250*a*, and a corresponding portion of the optical total reflection film 250*b* attached to the inner surface of the acrylic tube 250*a*. Accordingly, each of the inner spaces of the first and second air discharge ducts 251 and 252 functions as an air flow passage and a light travel path.

A rotating mirror 281 is arranged in the first air discharge duct 251 at a region where the first air discharge duct 251 is connected to the second air discharge duct 252 such that the rotating mirror 281 reflects light from the first air discharge duct 251 to the second air discharge duct 252. An incidence angle adjusting lens 282 is arranged in each of the first and second air discharge ducts 251 and 252, to adjust the incidence angle of light incident to the associated first or second air discharge duct 251 or 252.

Preferably, a first illuminance sensor 285 is arranged in the first air discharge duct 251, in order to measure the illuminance of the sunlight or artificial light supplied to the first air discharge duct 251. The first illuminance sensor 285 measures the illuminance of the sunlight, and determines, based on the result of the measurement, which one of the sunlight concentrator 221 and artificial light generator 222 should be controlled.

Preferably, a second illuminance sensor 286 is also arranged inside or outside the illumination/air discharge duct 250, in order to measure the illuminance of light totally reflected in the illumination/air discharge duct 250. When the amount of a contaminant attached to the optical total reflection film 250*b* of the illumination/air discharge duct 250 reaches a certain level, the total reflection efficiency of the optical total reflection film 250*b* is reduced to a certain level. Such a reduction in total reflection efficiency causes a decrease in the illuminance of the light traveling in the illumination/air discharge duct 250 and the illuminance of the light irradiated to the indoor space after emerging from the illumination/air discharge duct 250. The second illuminance sensor 286 sends information as to the measured illumination to a controller, in order to enable the controller to determine whether or not the air discharge duct cleaner 260 should operate.

Meanwhile, it is preferred that the air discharge duct cleaner 260 be arranged at an end of the illumination/air discharge duct 250. For example, the air discharge duct cleaner 260 may be arranged at the end of the second discharge duct 252 arranged opposite to the first air discharge duct 251, as in the illustrated case.

The air discharge duct cleaner 260 includes a fan unit 261 for discharging a contaminant from the illumination/air discharge duct 250 to the outdoors, along with air, and a cleaning damper 262 for opening or closing the end of the illumination/air discharge duct 250 where the air discharge duct cleaner 260 is arranged.

The cleaning damper 262 may have a structure enabling the cleaning damper 262 to be hingable about a hinge shaft, or may have various structures other than the hinge structure.

Figure 9:
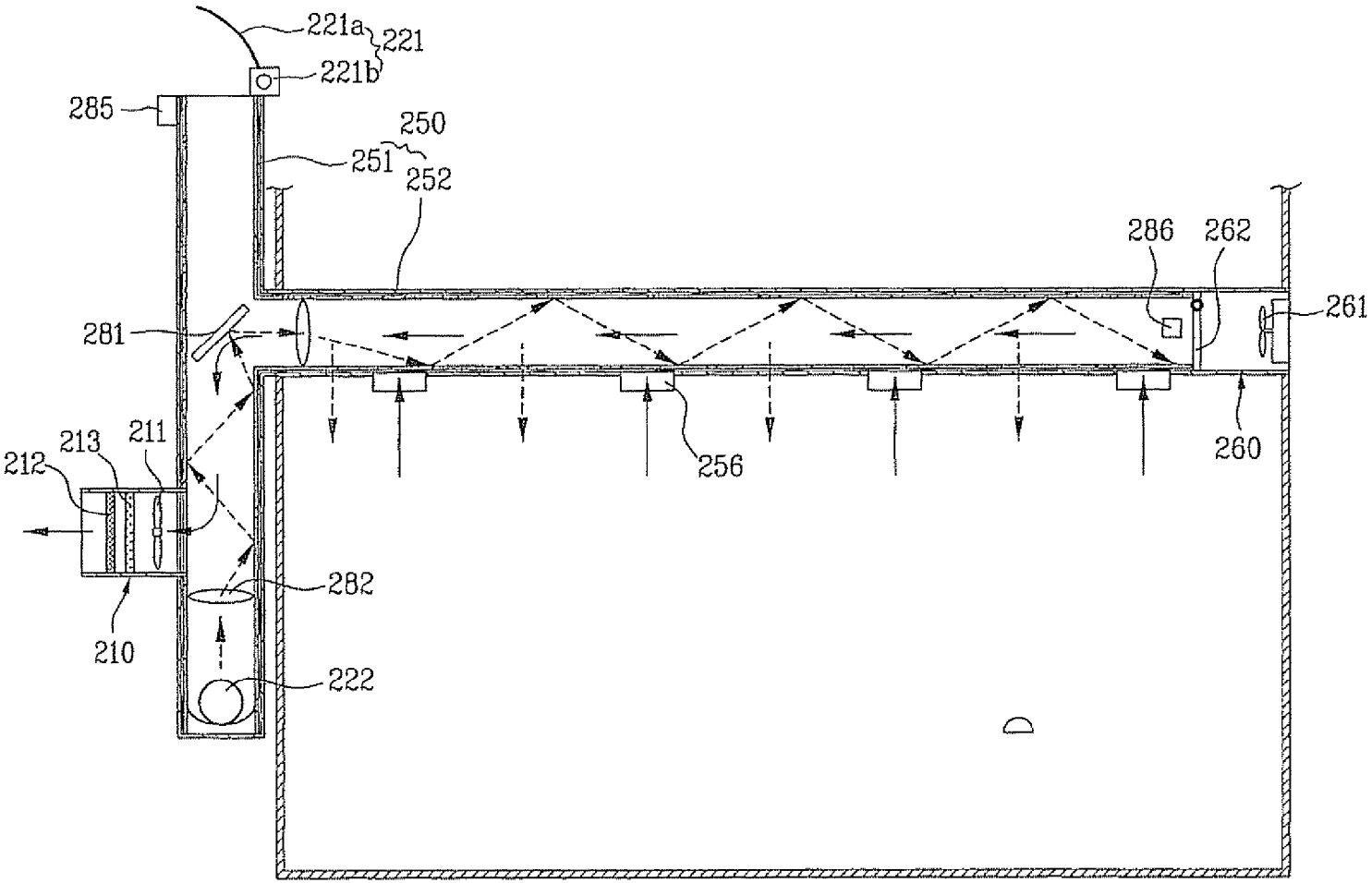
FIG. 9 is a schematic sectional view illustrating an artificial light illumination mode and an air discharge operation of the ventilation/illumination system shown in FIG. 6.

Hereinafter, operation of the ventilation/illumination system having the above-described configuration according to the second embodiment of the present invention will be described with reference to FIGS. 8 and 9. The case of FIGS. 8 and 9 corresponds to the case in which an illumination mode and a ventilation mode are simultaneously carried out. In FIGS. 8 and 9, flow of air is indicated by a solid line, whereas travel of light is indicated by a broken line.

The ventilation/illumination system can be operated in a natural illumination mode or in an artificial illumination mode in accordance with the illuminance of sunlight. Also, each illumination mode may be carried out simultaneously with or independently of the ventilation mode.

First, the illumination mode of the ventilation/illumination system will be described.

The ventilation/illumination system selectively operates the sunlight concentrator 221 or the artificial light generator 222, based on information as to the illuminance of sunlight sent from the first illuminance sensor 285. Of course, the sunlight concentrator 221 and artificial light generator 222 may be selectively operated in accordance with operation of the user.

When the sunlight concentrator 221 is operated, the sunlight concentrator 221 is first rotated, in accordance with the altitude of the sun, to an angular position where the sunlight concentrator 221 can concentrate a maximum amount of sunlight to the interior of the first air discharge duct 251, as shown in FIG. 8. On the other hand, when the artificial light generator 222 is operated, VHF artificial light is emitted from the artificial light generator 222, as shown in FIG. 9.

The sunlight or artificial light is incident to the first air discharge duct 251, and then travels along the first air discharge duct 251 while being totally reflected by the optical total reflection film 250*b*, as shown in FIG. 8 or 9.

The rotating mirror 281 in the first air discharge duct 251 reflects the totally-reflected light emerging from the first air discharge duct 251 to the second air discharge duct 252. At this time, the rotating mirror 281 has been rotated to a position corresponding to the natural illumination mode or artificial illumination mode associated with the totally-reflected light. The light reflected by the rotating mirror 281 is incident to the second air discharge duct 252 via the incidence angle adjusting lens 282 of the second air discharge duct 252. The incidence light travels along the second air discharge duct 252 while being totally reflected by the optical total reflection film 250*b*. During the travel thereof, the light in the second air discharge duct 252 is transmitted through the second air discharge duct 252, thereby illuminating the indoor space at a certain illumination level (lux).

Next, the ventilation mode of the ventilation/illumination system will be described.

When the ventilation device 210 is operated, indoor air is introduced into the second air discharge duct 252 after passing through the filter (not shown), and thus, being filtered. The filtered indoor air is discharged to the outdoors after flowing through the second air discharge duct 252 and first air discharge duct 251, in this order.

Also, outdoor air is introduced into the air supply duct 230 after passing through the filters 212 and 213, and thus, being filtered. The filtered outdoor air is discharged into the indoor space via the air supplying diffusers 236.

When the above-described ventilation mode is carried out for a prolonged period of time, a contaminant such as fine dust, which could not be removed by the filters 212 and 213, may be attached to the optical total reflection film 250*b* of the illumination/air discharge duct 250, thereby causing a considerable decrease in optical total reflection efficiency. To this end, the first and second illuminance sensors 285 and 286 measure illuminance of light, and send the measured illuminances to the controller. The controller then calculates a difference between the illuminances measured by the first and second illuminance sensors 285 and 286, and determines the contamination level of the illumination/air discharge duct 250, based on the calculated illuminance difference.

When the cleaning mode is begun, the controller first controls the fan unit 261 to be operated. Thereafter, the controller controls the cleaning damper 262 to be opened (as shown in FIG. 5). The fan unit 261 generates a strong flow of air in the illumination/air discharge duct 250, in order to detach the contaminant attached to the optical total reflection film 250*b*. At this time, the fan unit 261 generates air turbulence in the illumination/air discharge duct 250, in order to more easily detach the contaminant. The fan unit 261 then sucks the detached contaminant, to discharge the sucked contaminant to the outdoors. In accordance with these operations, the illumination/air discharge duct 250 is cleaned. Thus, the total reflection efficiency of the optical total reflection film 250*b* is substantially recovered.

Next, a ventilation/illumination system according to a third embodiment of the present invention will be described with reference to FIG. 10.

Figure 10:
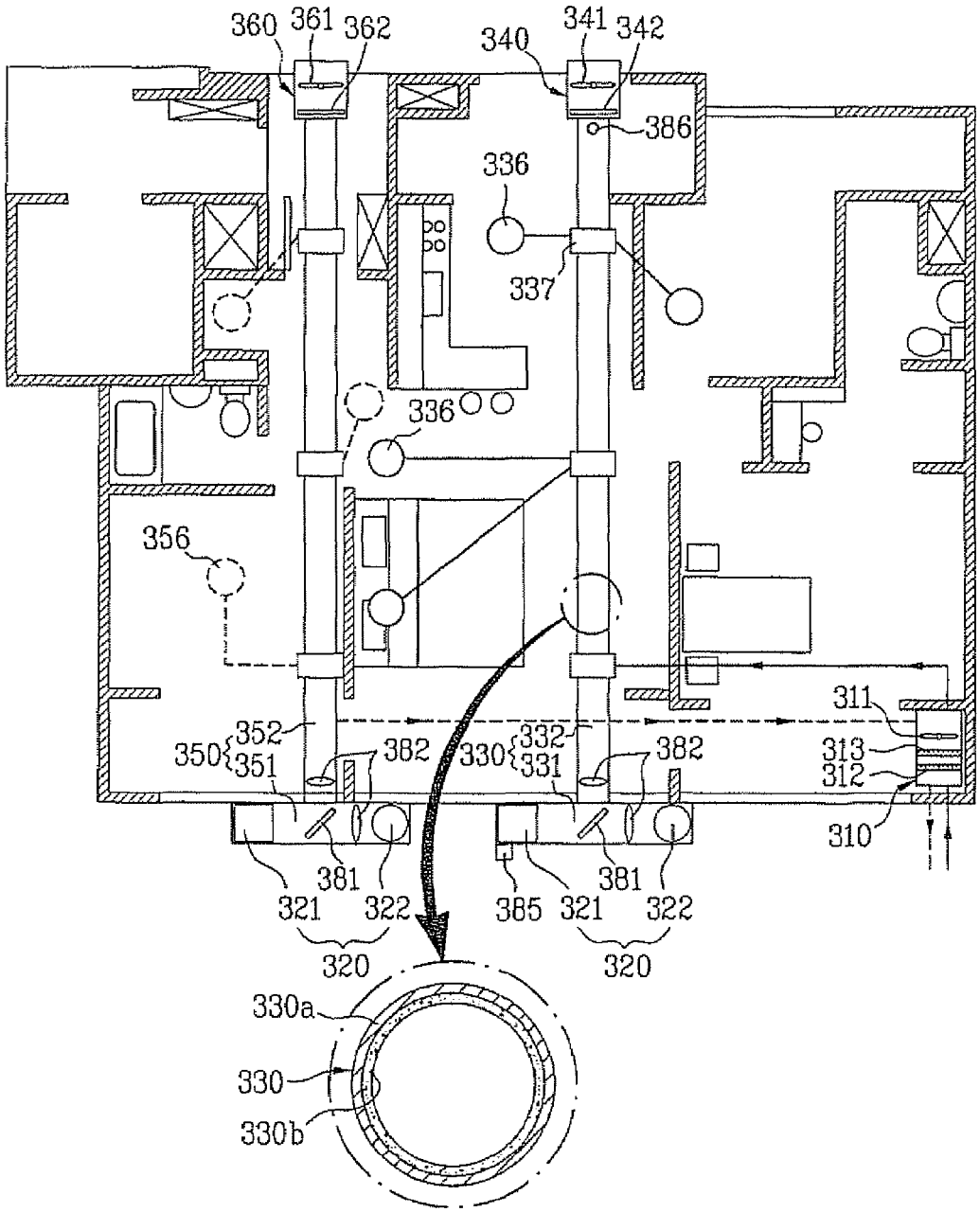
FIG. 10 is a schematic plan view illustrating a configuration of a ventilation/illumination system according to a third embodiment of the present invention.

As shown in FIG. 10, the ventilation/illumination system includes a ventilation device 310 for blowing outdoor air, and a light supplying device 320 for supplying light. The ventilation/illumination system also includes an illumination/air supply duct 330 for not only guiding the outdoor air blown by the ventilation device 310 such that the outdoor air is discharged into an indoor space, but also guiding light such that the light travels along the illumination/air supply duct 330 while being totally reflected, to illuminate an indoor space. The ventilation/illumination system also includes an illumination/air discharge duct 350 for not only guiding indoor air, to discharge the indoor air to the outdoors, but also guiding light such that the light travels along the illumination/air discharge duct 350 while being totally reflected, to illuminate the indoor space. The ventilation/illumination system further includes an air supply duct cleaner 340 arranged in the illumination/air supply duct 330.

Since the ventilation device 310 is substantially identical to that of the first embodiment, no description thereof will be given. In FIG. 10, reference numeral 311 designates the fan unit of the ventilation device 310.

The illumination/air supply duct 330 is connected to the ventilation device 310. Air supplying diffusers 336 are connected to the illumination/air supply duct 330.

The illumination/air discharge duct 350 is also connected to the ventilation device 310. In this connection, the ventilation/illumination system preferably further includes a discharge duct cleaner 360 arranged in the illumination/air discharge duct 350.

Air discharging diffusers 356 are connected to the illumination/air discharge duct 350.

Preferably, filters 312 and 313 are arranged in the ventilation device 310, in order to filter outdoor air, and thus, to enable filtered air to be supplied to the illumination/air supply duct 330.

Preferably, a filter (not shown) is also arranged in the illumination/air discharge duct 350, in order to filter indoor air, and thus, to enable filtered air to be supplied to the illumination/air discharge duct 350. Accordingly, it is possible to prevent a contaminant such as dust contained in indoor air from being attached to the optical total reflection film 350*b*. As described above, when a contaminant is attached to the optical total reflection film, the optical total reflection efficiency of the optical total reflection film 350*b* is reduced. Also, it will be appreciated that a deodorizing filter 313 may be installed in the ventilation device 110, in order to deodorize outdoor air.

Each of the illumination/air supply duct 330 and illumination/air discharge duct 350 may have a rectilinear structure, or may have a bent structure. Where the illumination/air supply or discharge duct 330 or 350 has a bent structure, it is preferred that mirrors (not shown) be arranged at bent portions of the illumination/air supply or discharge duct 330 or 350, in order to reflect light in desired directions, respectively (as shown in FIG. 2).

The illumination/air supply or discharge duct 330 or 350 is constituted by two or more optical pipes, adjacent ones of which are connected by an associated connector 337 or 357. Preferably, each of the air supplying diffusers 336 and air discharging diffusers 356 is connected to the associated connector 337 or 357 via a connecting pipe.

A first embodiment of the light supplying device 320 will be described with reference to FIG. 10.

In the embodiment of FIG. 10, the light supplying device 320 includes sunlight concentrators 321 respectively arranged in the illumination/air supply duct 330 and illumination/air discharge duct 350, and adapted to supply concentrated sunlight, and artificial light generators 322 respectively arranged in the illumination/air supply duct 330 and illumination/air discharge duct 350, and adapted to supply artificial light.

It is preferred that each sunlight concentrator 321 be rotatable in accordance with the altitude of the sun, in order to efficiently concentrate sunlight to an associated one of the illumination/air supply duct 330 and illumination/air discharge duct 350. Each sunlight concentrator 321 includes a light concentrating plate 321*a* for concentrating sunlight to the interior of an associated one of the illumination/air supply duct 330 and illumination/air discharge duct 350, and a motor 321*b* for rotating the light concentrating plate 321*a*. Although each light supplying device 320 is illustrated as including one sunlight concentrator 321 directed in one of the sunrise and sunset directions, sunlight concentrators 321 may be arranged to be directed in both the sunrise and sunset directions, respectively. In either case, each light supplying device 320 may include a plurality of sunlight concentrators 321.

Each artificial light generator 322 is constituted by a lamp adapted to generate artificial light, using a very high frequency (VHF) discharge. Since the artificial light generator 322 is substantially identical to that of the first embodiment of the ventilation/illumination system, no description thereof will be given.

Hereinafter, a second embodiment of the light supplying device 320 will be described with reference to FIG. 11.

Figure 11:
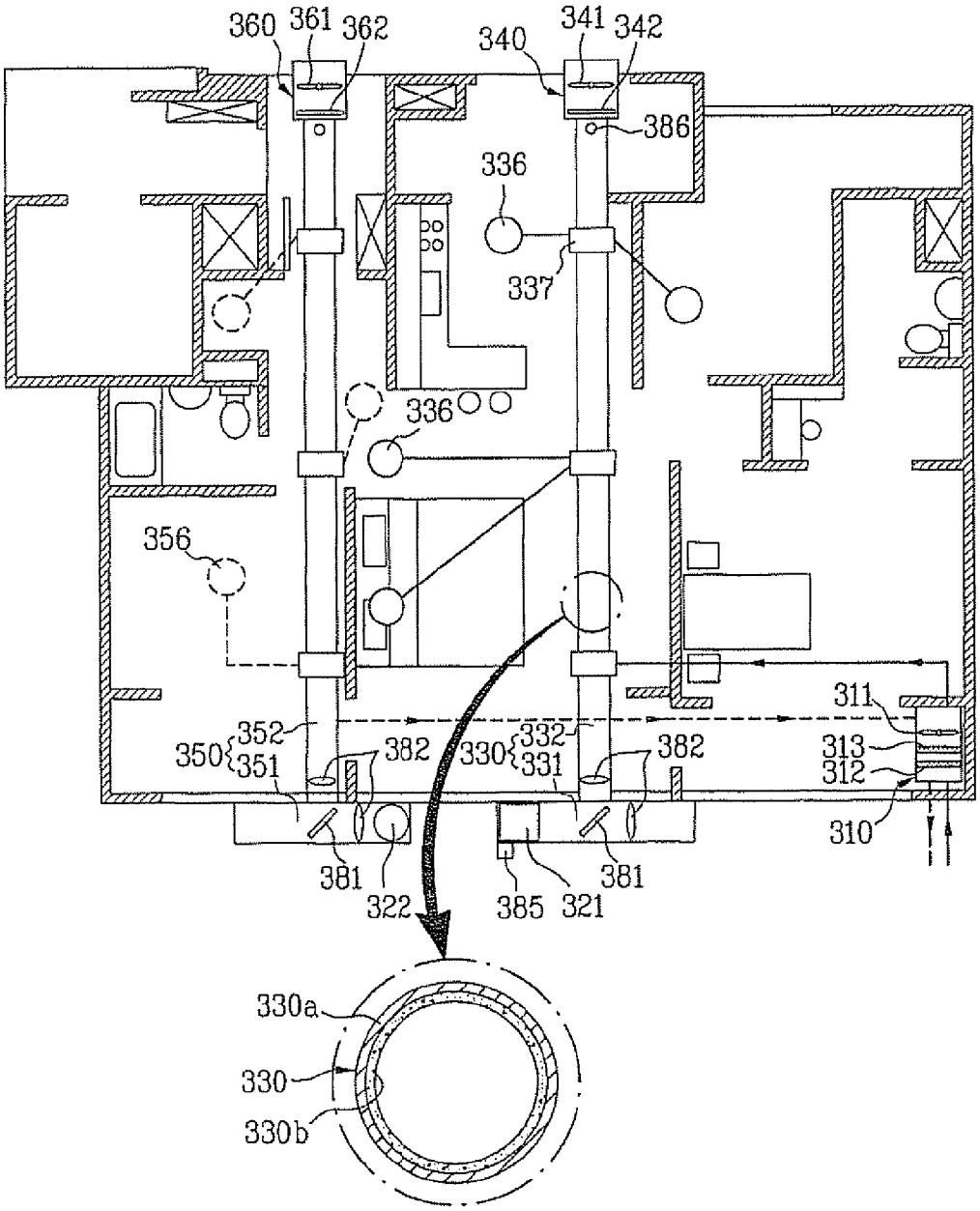
FIG. 11 is a schematic plan view illustrating a modification of the ventilation/illumination system shown in FIG, 10.

In the embodiment of FIG. 11, the light supplying device 320 includes a sunlight concentrator 321 arranged in the illumination/air supply duct 330, and adapted to supply concentrated sunlight, and an artificial light generator 322 arranged in the illumination/air discharge duct 350, and adapted to supply artificial light.

Next, a third embodiment of the light supplying device 320 will be described with reference to FIG. 12.

Figure 12:
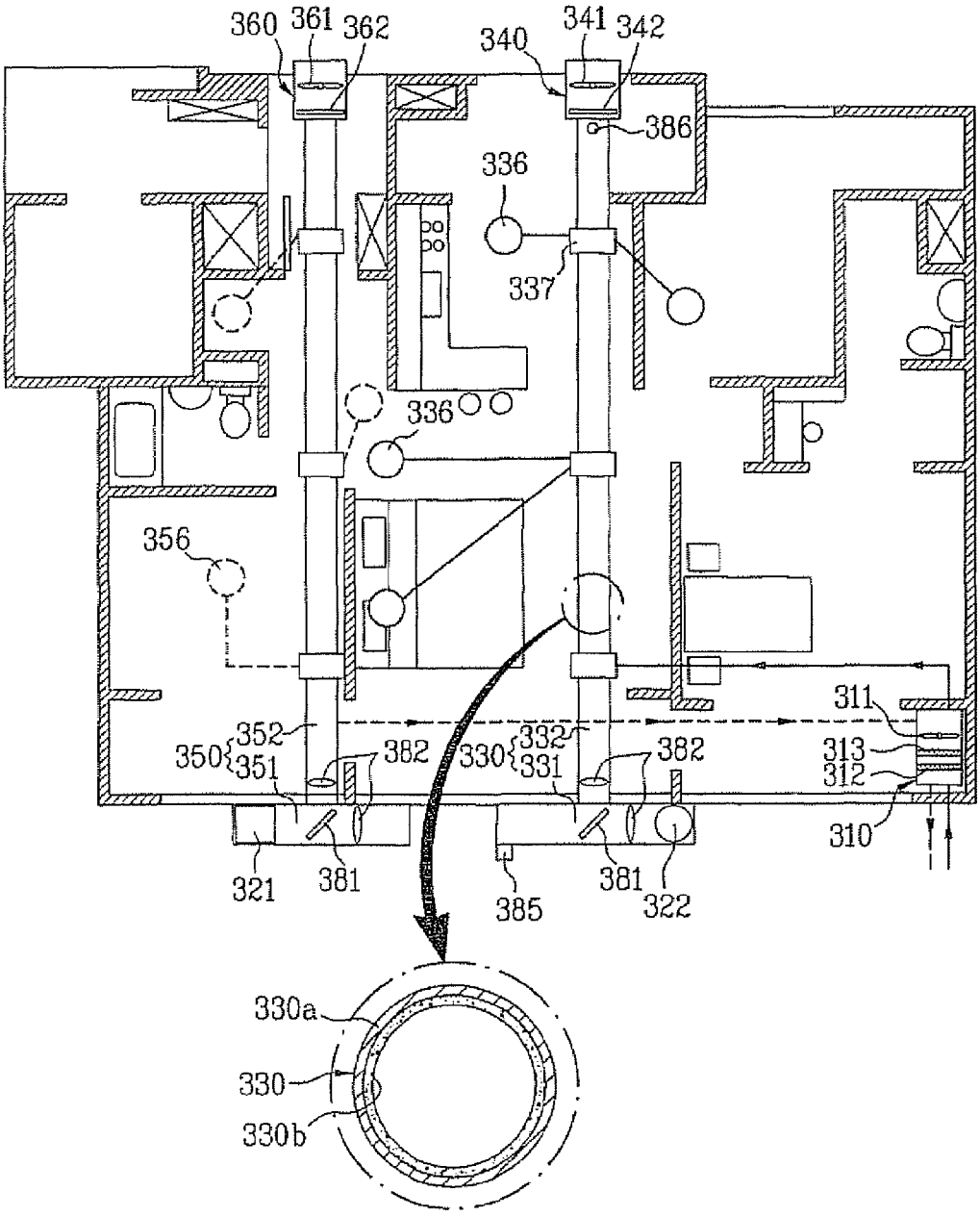
FIG. 12 is a schematic plan view illustrating another modification of the ventilation/illumination system shown in FIG. 10.

In the embodiment of FIG. 12, the light supplying device 320 includes a sunlight concentrator 321 arranged in the illumination/air discharge duct 350, and adapted to supply concentrated sunlight, and an artificial light generator 322 arranged in the illumination/air supply duct 330, and adapted to supply artificial light.

Thus, a pair of sunlight concentrators 321 and a pair of artificial light generators 322 may be installed at the illumination/air supply duct 330 and illumination/air discharge duct 350, respectively, or one sunlight concentrator 321 and one artificial light generator 322 may be selectively installed at the illumination/air supply duct 330 and illumination/air discharge duct 350, respectively. The configurations of FIGS. 10 to 12 are identical, except for the configuration of the light supplying device 320.

Meanwhile, the illumination/air supply duct 330 includes a first air supply duct 331 connected to the ventilation device 310, and adapted to guide light and outdoor air, and a second air supply duct 332 connected to the first air supply duct 331, and arranged in the indoor space. The second air supply duct 332 functions to guide light and outdoor air, to supply the light and outdoor air to the indoor space.

The illumination/air discharge duct 350 includes a first air discharge duct 351 connected to the ventilation device 310, and adapted to guide light and to discharge indoor air to the outdoors, and a second air discharge duct 352 connected to the first air discharge duct 351, and arranged in the indoor space. The second air discharge duct 352 functions to discharge indoor air into the first air discharge duct 351.

Each of the first air supply duct 331 and first air discharge duct 351 may be arranged at the outdoors, or may be embedded in a wall of a building in which the ventilation/illumination system is installed.

Where the first air supply duct 331 and first air discharge duct 351 are arranged at the outdoors, it is preferred that light in the first air supply duct 331 and first air discharge duct 351 be prevented from being outwardly leaked from the first air supply duct 331 and first air discharge duct 351. For example, when the first air supply duct 331 and first air discharge duct 351 are made of acrylic resin allowing light to be transmitted therethrough, separate light shield ducts (not shown) are arranged around the first air supply duct 331 and first air discharge duct 351, respectively. Of course, the first air supply duct 331 and first air discharge duct 351 may be made of a material preventing light from being transmitted therethrough. In this case, it is unnecessary to install separate light shield ducts around the first air supply duct 331 and first air discharge duct 351.

The optical total reflection film 350*b* extends along the inner surfaces of the first and second air supply ducts 331 and 332, and first and second air discharge ducts 351 and 352 such that the optical total reflection film 350*b* surrounds air flow passages defined in the illumination/air supply duct 330 and illumination/air discharge duct 350 along the first and second air supply ducts 331 and 332 and first and second air discharge ducts 351 and 352.

Rotating mirrors 381 are arranged in the first air supply duct 331 and first air discharge duct 351 at regions where the first air supply duct 331 and first air discharge duct 351 are connected to the second air supply duct 332 and second air discharge duct 352 such that the rotating mirrors 381 reflect light from the first air supply duct 331 and first air discharge duct 351 to the second air supply duct 332 and second air discharge duct 352, respectively. An incidence angle adjusting lens 382 is arranged in each of the first and second air supply ducts 331 and 332, and air discharge ducts 351 and 352, to adjust the incidence angle of light incident to an associated one of the first and second air supply ducts 331 and 332, and first and second air discharge duct 351 and 352.

Preferably, a first illuminance sensor 385 is arranged in at least one of the first air supply duct 331 and first air discharge duct 351, in order to measure the illuminance of the sunlight or artificial light supplied to the first air supply duct 331 and/or first air discharge duct 351. The first illuminance sensor 385 measures the illuminance of the sunlight, and determines, based on the result of the measurement, which one of the associated sunlight concentrator 321 and artificial light generator 322 should be controlled. It will be appreciated that the first illuminance sensor 385 may be arranged at only one of the first air supply duct 331 and first air discharge duct 351.

Preferably, a second illuminance sensor 386 is also arranged inside or outside the illumination/air supply duct 330, in order to measure the illuminance of light totally reflected in the illumination/air supply duct 330. The second illuminance sensor 386 sends information as to the measured illumination to a controller, in order to enable the controller to determine whether or not the air supply duct cleaner 340 should operate. Of course, it will be appreciated that another second illuminance sensor 386 may be arranged in association with the air discharge duct cleaner 360.

Meanwhile, it is preferred that the air supply duct cleaner 340 be arranged at an end of the illumination/air supply duct 330. For example, the air supply duct cleaner 340 may be arranged at the end of the second supply duct 332 arranged opposite to the first air supply duct 331, as in the illustrated case.

The air supply duct cleaner 340 includes a fan unit 341 for discharging a contaminant from the illumination/air supply duct 330 to the outdoors, along with air, and a cleaning damper 342 for opening or closing the end of the illumination/air supply duct 330 where the air supply duct cleaner 340 is arranged.

Preferably, the air discharge duct cleaner 360 is arranged at an end of the illumination/air discharge duct 350. For example, the air discharge duct cleaner 360 may be arranged at the end of the second discharge duct 352 arranged opposite to the first air discharge duct 351, as in the illustrated case.

The air discharge duct cleaner 360 includes a fan unit 361 for discharging a contaminant from the illumination/air discharge duct 350 to the outdoors, along with air, and a cleaning damper 362 for opening or closing the end of the illumination/air discharge duct 350 where the air discharge duct cleaner 360 is arranged.

Since the function of the ventilation/illumination system according to the third embodiment of the present invention is identical to those of the first and second embodiments, no description thereof will be given. However, the third embodiment is different from the first and second embodiments in that it is possible to illuminate the indoor space by both the illumination/air supply duct 330 and the illumination/air discharge duct 350. The third embodiment is also different from the first and second embodiments in that the light supplying device 320 and cleaners 340 and 360 can be operated in a simultaneous manner or in an independent manner.

Figure 13:
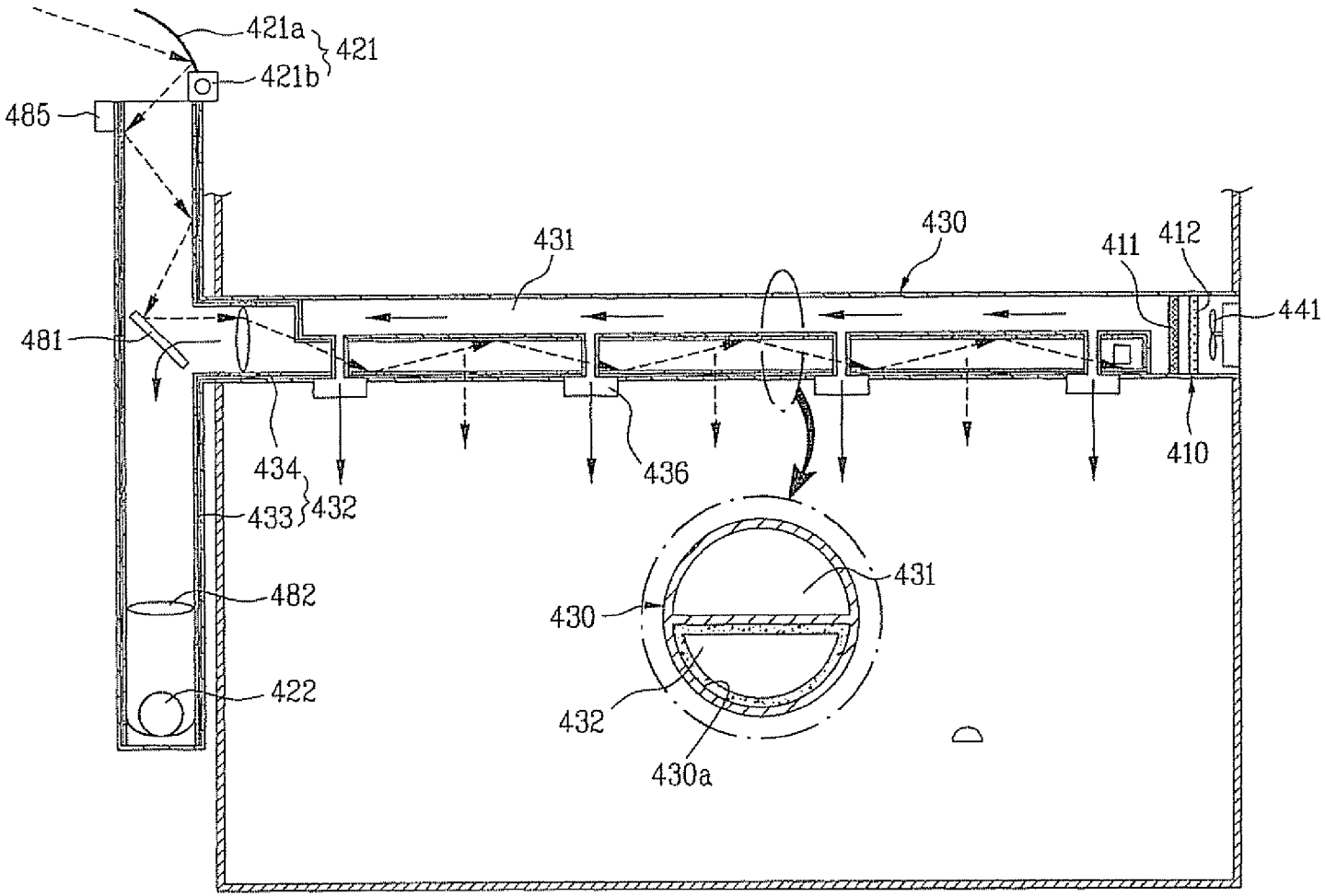
FIG. 13 is a schematic sectional view illustrating a configuration of a ventilation/illumination system according to a fourth embodiment of the present invention.

Next, a ventilation/illumination system according to a fourth embodiment of the present invention will be described with reference to FIG. 13. In FIG. 13, flow of air is indicated by a solid line, whereas travel of light is indicated by a broken line.

As shown in FIG. 13, the ventilation/illumination system includes a ventilation device 410 for blowing outdoor air, a light supplying device for supplying light, and an illumination/air supply duct 430 in which an air supply passage and a light passage are defined. The light supplying device includes two elements 421 and 422, as will be described hereinafter. The illumination/air supply duct 430 includes an air supply guide 431 connected to the ventilation device 410, and adapted to guide outdoor air to an indoor space, and a light guide 432 formed such that the light guide 432 is independent of the air supply guide 431. The light guide 432 is connected to the light providing device, and is adapted to guide light therethrough while totally reflecting the light, to enable the light to illuminate the indoor space.

In this ventilation/illumination system, it is unnecessary to install a separate cleaner because the air supply guide 431 and light guide 432 are formed independently of each other.

Since the ventilation device 410 is substantially identical to that of the first embodiment associated with the ventilation/illumination system, no description thereof will be given. However, the ventilation device 410 does not function to cause air to flow through the light guide 432. In FIG. 13, reference numeral 441 designates a fan unit, and reference numerals 411 and 412 designate filters, respectively.

The illumination/air supply duct 430 is connected to the ventilation device 410. Air supplying diffusers 436 are connected to the illumination/air supply duct 430. Preferably, an air discharge duct (not shown) for discharging indoor air to the outdoors is connected to the ventilation device 410. In this case, air discharging diffusers (not shown) are connected to the air discharge duct. In FIG. 13, only the air supply diffusers 436 are shown.

The illumination/air supply duct 430 may have a rectilinear structure, or may have a bent structure where the illumination/air supply duct 430 has a bent structure, it is preferred that mirrors (as indicated by "183" in FIG. 2) be arranged at bent portions of the illumination/air supply duct 430, in order to reflect light in desired directions, respectively.

Meanwhile, the light supplying device includes a sunlight concentrator which is the element 421 (hereinafter, the element 421 will be referred to as a "sunlight concentrator"), and an artificial light generator which is the element 422 (hereinafter, the element 422 will be referred to as an "artificial light generator"). The sunlight concentrator 421 is arranged in the light guide 432, to supply concentrated sunlight. The artificial light generator 422 is arranged in the light guide 432, to supply artificial light.

The light supplying device may include only the artificial light generator 422.

It is preferred that the sunlight concentrator 421 be rotatable in accordance with the altitude of the sun, in order to efficiently concentrate sunlight to the light guide 432. The sunlight concentrator 421 includes a light concentrating plate 421*a* for concentrating sunlight to the interior of the light guide 432, and a motor 421*b* for rotating the light concentrating plate 421*a*. Although the light supplying device is illustrated as including one sunlight concentrator 421 directed in one of the sunrise and sunset directions, sunlight concentrators 421 may be arranged to be directed in both the sunrise and sunset directions, respectively. In either case, the light supplying device may include a plurality of sunlight concentrators 421.

The light guide 432 includes a first optical pipe 433 connected to the light supplying device, and adapted to guide light therethrough while totally reflecting the light, and a second optical pipe 434 connected to the first optical pipe 433, and adapted to guide light therethrough while enabling the light to be irradiated to the indoor space.

Preferably, the air supply guide 431 is arranged on only the second optical pipe 434. In detail, the air supply guide 431 is formed integrally with the second optical pipe 434 such that the air supply guide 431 extends along the second optical pipe 434.

The first optical pipe 433 is connected to one end of the second optical pipe 434. The ventilation device 410 is arranged at the other end of the second optical pipe 434.

The first optical pipe 433 may be arranged at the outdoors, or may be embedded in a wall of a building in which the ventilation/illumination system is installed.

Where the first optical pipe 433 is arranged at the outdoors, it is preferred that light in the first optical pipe 433 be prevented from being outwardly leaked from the first optical pipe 433. For example, when the first optical pipe 433 is made of acrylic resin allowing light to be transmitted therethrough, a separate light shield duct is arranged around the first optical pipe 433. Of course, the first optical pipe 433 may be made of a material preventing light from being transmitted therethrough. In this case, it is unnecessary to install a separate light shield duct around the first optical pipe 433.

A rotating mirror 481 is arranged in the first optical pipe 433 at a region where the first optical pipe 433 is connected to the second optical pipe 434 such that the rotating mirror 481 reflects light from the first optical pipe 433 to the second optical pipe 434. An incidence angle adjusting lens 482 is arranged in each of the first and second optical pipes 433 and 434, to adjust the incidence angle of light incident to the associated first or second optical pipes 433 and 434.

Preferably, a first illuminance sensor 485 is arranged in the first optical pipe 433, in order to measure the illuminance of the sunlight or artificial light supplied to the first optical pipe 433. The first illuminance sensor 485 measures the illuminance of the sunlight, and determines, based on the result of the measurement, which one of the sunlight concentrator 421 and artificial light generator 422 should be controlled.

Hereinafter, a first embodiment of the illumination/air supply duct will be described with reference to FIG. 13.

In the illumination/air supply duct 430 shown in FIG. 13, the air supply guide 431 is separated from the light guide 432 by a barrier wall extending in a portion of the illumination/air supply duct 430 corresponding to the second optical pipe 434 in a longitudinal direction of the illumination/air supply duct 430. In this case, it is preferred that a portion of the light guide 432 corresponding to the second optical pipe 434 be exposed to the indoor space. An optical total reflection film 430*a* is attached to an inner surface of the light guide 432.

The portion of the light guide 432 corresponding to the second optical pipe 434 has a substantially semicircular cross-section. However, the light guide 432 is not limited to such a cross-section.

Preferably, the air supply guide 431 is made of a flexible material.

The air supplying diffusers 436 are connected to the air supply guide 431.

Next, a second embodiment of the illumination/air supply duct will be described with reference to FIG. 14., In this embodiment, the illumination/air supply duct, which is designated by reference numeral "470" in FIG. 14, has a double pipe structure at a portion thereof corresponding to the second optical pipe 434. That is, the double pipe structure of the illumination/air supply duct 470 forms an air supply guide 471 and a light guide 472 such that the light guide 472 is arranged around the air supply guide 471. The light guide 472 is arranged such that it is completely exposed to the indoor space, or is partially embedded in a ceiling of the indoor space. Optical total reflection films 470*a* are attached to an inner surface of the light guide 472 and an outer surface of the air supply guide 471, respectively.

Support members 473 are interposed between the air supply guide 471 and the light guide 472. The support members 473 support the air supply guide 471 such that the air supply guide 471 is maintained in a state of being uniformly spaced from the light guide 472. The support members 473 may have various structures, as long as they firmly support the air supply guide 471.

Hereinafter, operation of the ventilation/illumination system having the above-described configuration according to the fourth embodiment of the present invention will be described. The following description will be given in conjunction with the first embodiment of the illumination/air supply duct.

The ventilation/illumination system can be operated in a natural illumination mode or in an artificial illumination mode in accordance with the illuminance of sunlight. Also, each illumination mode may be carried out simultaneously with or independently of a ventilation mode.

First, the illumination mode of the ventilation/illumination system will be described.

The ventilation/illumination system selectively operates the sunlight concentrator 421 or the artificial light generator 422, based on information as to the illuminance of sunlight sent from the first illuminance sensor 485. Of course, the sunlight concentrator 421 and artificial light generator 422 may be selectively operated in accordance with operation of the user.

When the sunlight concentrator 421 is operated, the sunlight concentrator 421 is first rotated, in accordance with the altitude of the sun, to an angular position where the sunlight concentrator 421 can concentrate a maximum amount of sunlight to the interior of the first optical pipe 433. On the other hand, when the artificial light generator 422 is operated, VHF artificial light is emitted from the artificial light generator 422.

The sunlight or artificial light is incident to the first optical pipe 433, and then travels along the first optical pipe 433 while being totally reflected by the optical total reflection film 430*a*.

The rotating mirror 481 in the first optical pipe 433 reflects the totally-reflected light emerging from the first optical pipe 433 to the second optical pipe 434. At this time, the rotating mirror 481 has been rotated to a position corresponding to the natural illumination mode or artificial illumination mode associated with the totally-reflected light. The light reflected by the rotating mirror 481 is incident to the second optical pipe 434 via the incidence angle adjusting lens 482 of the second optical pipe 434. The incidence light travels along the second optical pipe 434 while being totally reflected by the optical total reflection film 430*a*. During the travel thereof, the light in the second optical pipe 434 is transmitted through the second optical pipe 434, thereby illuminating the indoor space at a certain illumination level (lux).

Next, the ventilation mode of the ventilation/illumination system will be described.

When the ventilation device 410 is operated, outdoor air is introduced into the air supply guide 431 after passing through the filters 412 and 413, and thus, being filtered. The filtered outdoor air is discharged into the indoor space via the air supplying diffusers 436. Thus, the indoor space is ventilated by the filtered outdoor air. Air present in the indoor space, namely, indoor air, is discharged to the outdoors via the air discharge duct. As described above, the ventilation device 410 does not operate to cause air to flow through the light guide 432.

Figure 15:
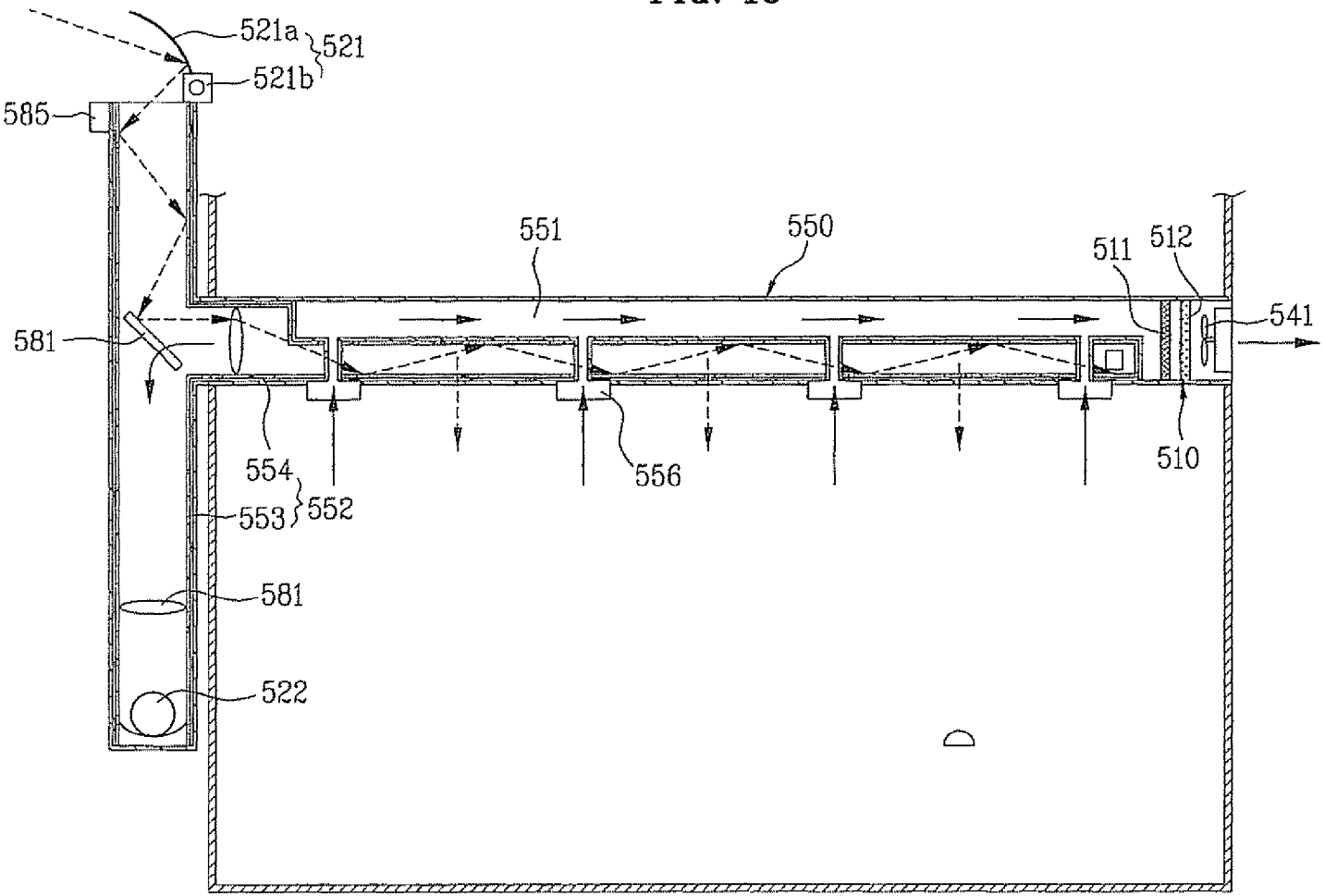
FIG. 15 is a schematic sectional view illustrating a configuration of a ventilation/illumination system according to a fifth embodiment of the present invention.

Hereinafter, a ventilation/illumination system according to a fifth embodiment of the present invention will be described with reference to FIG. 15. In FIG. 15, flow of air is indicated by a solid line, whereas travel of light is indicated by a broken line.

As shown in FIG. 15, the ventilation/illumination system includes a ventilation device 510 for blowing outdoor air, a light supplying device for supplying light, and an illumination/air discharge duct 550 in which an air discharge passage and a light passage are defined such that they are independent of each other. The light supplying device includes two elements 521 and 522, as will be described hereinafter. The illumination/air discharge duct 550 includes an air discharge guide 551 connected to the ventilation device 510, and adapted to guide indoor air to the outdoors, and a light guide 552 formed such that the light guide 552 is independent of the air discharge guide 551. The light guide 552 is connected to the light providing device, and is adapted to guide light therethrough while totally reflecting the light, to enable the light to illuminate the indoor space.

In this ventilation/illumination system, it is unnecessary to install a separate cleaner because the air discharge guide 551 and light guide 552 are formed independently of each other.

Since the ventilation device 510 is substantially identical to that of the first embodiment associated with the ventilation/illumination system, no description thereof will be given However, the ventilation device 510 does not function to cause air to flow through the light guide 552. In FIG. 15, reference numeral 541 designates a fan unit, and reference numerals 511 and 512 designate filters, respectively.

Air discharging diffusers 556 are connected to the air discharge guide 551.

Preferably, a filter 512 is also arranged in the ventilation device 510, in order to filter indoor air, and thus, to enable filtered air to be supplied to the illumination/air discharge duct 550. Accordingly, it is possible to prevent a contaminant such as dust contained in indoor air and outdoor air from being attached to an optical total reflection film of the illumination/air discharge duct 550, and thus, to prevent a degradation in optical total reflection efficiency.

The illumination/air discharge duct 550 may have a rectilinear structure, or may have a bent structure. Where the illumination/air discharge duct 550 has a bent structure, it is preferred that mirrors (as indicated by "183" in FIG. 2) be arranged at bent portions of the illumination/air discharge duct 550, in order to reflect light in desired directions, respectively.

Meanwhile, the light supplying device includes a sunlight concentrator which is the element 521 (hereinafter, the element 521 will be referred to as a "sunlight concentrator"), and an artificial light generator which is the element 522 (hereinafter, the element 522 will be referred to as an "artificial light generator"). The sunlight concentrator 521 is arranged in the light guide 552, to supply concentrated sunlight. The artificial light generator 522 is arranged in the light guide 552, to supply artificial light.

The light supplying device may include only the artificial light generator 522.

It is preferred that the sunlight concentrator 521 be rotatable in accordance with the altitude of the sun, in order to efficiently concentrate sunlight to the light guide 552. The sunlight concentrator 521 includes a light concentrating plate 521*a* for concentrating sunlight to the interior of the light guide 552, and a motor 521*b* for rotating the light concentrating plate 521*a*. Although the light supplying device is illustrated as including one sunlight concentrator 521 directed in one of the sunrise and sunset directions, sunlight concentrators 521 may be arranged to be directed in both the sunrise and sunset directions, respectively. In either case, the light supplying device may include a plurality of sunlight concentrators 521.

The light guide 552 includes a first optical pipe 553 connected to the light supplying device, and adapted to guide light therethrough while totally reflecting the light, and a second optical pipe 554 connected to the first optical pipe 553, and adapted to guide light therethrough while enabling the light to be irradiated to the indoor space.

Preferably, the air discharge guide 551 is arranged on only the second optical pipe 554. In detail, the air discharge guide 551 is formed integrally with the second optical pipe 554 such that the air discharge guide 551 extends along the second optical pipe 554.

The first optical pipe 553 is connected to one end of the second optical pipe 554. The ventilation device 510 is arranged at the other end of the second optical pipe 554.

The first optical pipe 553 may be arranged at the outdoors, or may be embedded in a wall of a building in which the ventilation/illumination system is installed.

Where the first optical pipe 553 is arranged at the outdoors, it is preferred that light in the first optical pipe 553 be prevented from being outwardly leaked from the first optical pipe 553. For example, when the first optical pipe 553 is made of acrylic resin allowing light to be transmitted therethrough, a separate light shield duct is arranged around the first optical pipe 553. Of course, the first optical pipe 553 may be made of a material preventing light from being transmitted therethrough. In this case, it is unnecessary to install a separate light shield duct around the first optical pipe 553.

A rotating mirror 581 is arranged in the first optical pipe 553 at a region where the first optical pipe 553 is connected to the second optical pipe 554 such that the rotating mirror 581 reflects light from the first optical pipe 553 to the second optical pipe 554. An incidence angle adjusting lens 582 is arranged in each of the first and second optical pipes 553 and 554, to adjust the incidence angle of light incident to the associated first or second optical pipes 553 and 554.

Preferably, a first illuminance sensor 585 is arranged in the first optical pipe 553, in order to measure the illuminance of the sunlight or artificial light supplied to the first optical pipe 553. The first illuminance sensor 585 measures the illuminance of the sunlight, and determines, based on the result of the measurement, which one of the sunlight concentrator 521 and artificial light generator 522 should be controlled.

In the illumination/air discharge duct 550 shown in FIG. 13, the air discharge guide 551 is separated from the light guide 552 by a barrier wall extending in a portion of the illumination/air discharge duct 550 corresponding to the second optical pipe 554 in a longitudinal direction of the illumination/air discharge duct 550. In this case, it is preferred that a portion of the light guide 552 corresponding to the second optical pipe 554 be exposed to the indoor space. An optical total reflection film is attached to an inner surface of the light guide 552.

The portion of the light guide 552 corresponding to the second optical pipe 554 may have a substantially semicircular cross-section. However, the light guide 552 is not limited to such a cross-section.

Preferably, the air discharge guide 551 is made of a flexible material.

As described above, the air discharging diffusers 556 are connected to the air discharge guide 551.

Figure 14:
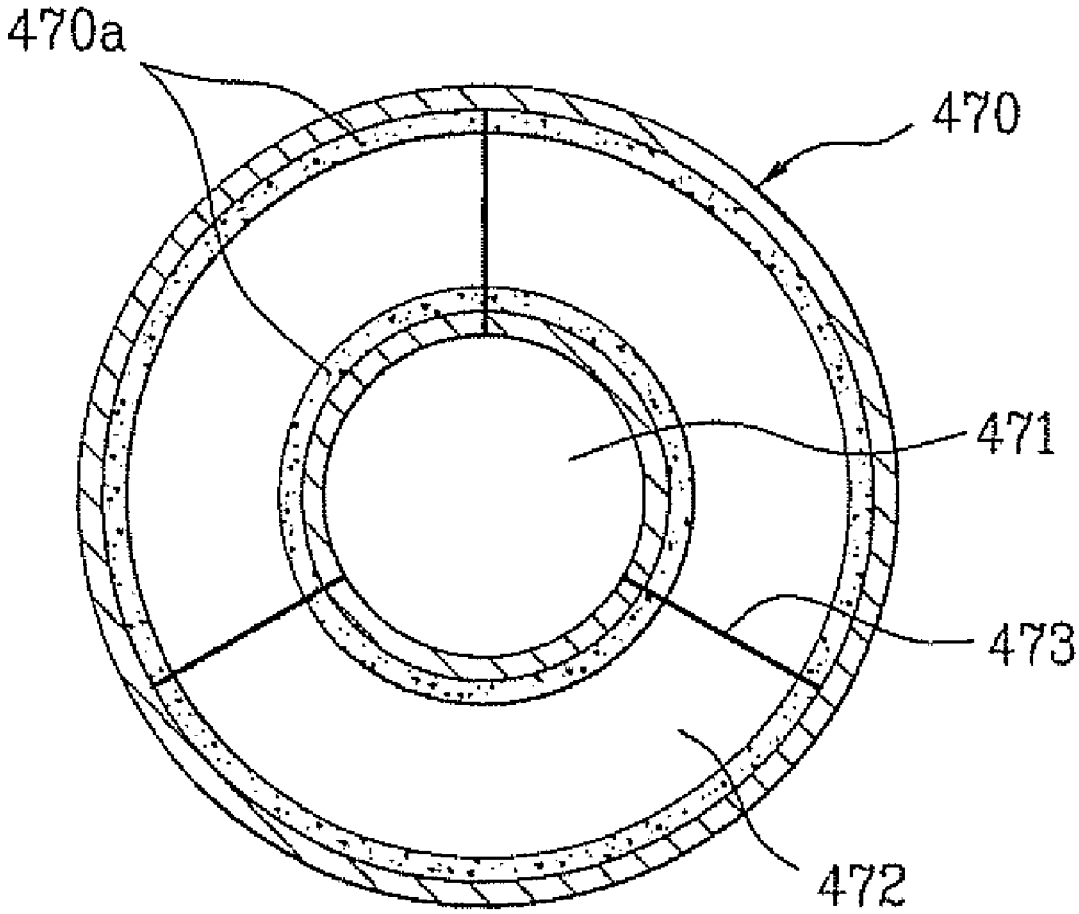
FIG. 14 is a schematic sectional view illustrating a modification of an illumination/air supply duct shown in FIG. 13.

Similarly to the case of FIG. 14, the illumination/air discharge duct may have a double pipe structure at a portion thereof corresponding to the second optical pipe 554. In this case, the double pipe structure of the illumination/air supply duct 570 forms an air discharge guide ("471" in FIG. 14) and a light guide ("472" in FIG. 14) such that the light guide is arranged around the air discharge guide. The light guide is arranged such that it is exposed to the indoor space. Optical total reflection films are attached to an inner surface of the light guide and an outer surface of the air discharge guide, respectively.

Support members ("473," in FIG. 14) are interposed between the air discharge guide and the light guide. The support members support the air discharge guide such that the air discharge guide is maintained in a state of being uniformly spaced from the light guide.

Hereinafter, operation of the ventilation/illumination system having the above-described configuration according to the fifth embodiment of the present invention will be described.

The ventilation/illumination system can be operated in a natural illumination mode or in an artificial illumination mode in accordance with the illuminance of sunlight. Also, each illumination mode may be carried out simultaneously with or independently of a ventilation mode.

First, the illumination mode of the ventilation/illumination system will be described.

The ventilation/illumination system selectively operates the sunlight concentrator 521 or the artificial light generator 522, based on information as to the illuminance of sunlight sent from the first illuminance sensor 585. Of course, the sunlight concentrator 521 and artificial light generator 522 may be selectively operated in accordance with operation of the user.

When the sunlight concentrator 521 is operated, the sunlight concentrator 521 is first rotated, in accordance with the altitude of the sun, to an angular position where the sunlight concentrator 521 can concentrate a maximum amount of sunlight to the interior of the first optical pipe 553. On the other hand, when the artificial light generator 522 is operated, VHF artificial light is emitted from the artificial light generator 522.

The sunlight or artificial light is incident to the first optical pipe 553, and then travels along the first optical pipe 553 while being totally reflected.

The rotating mirror 581 in the first optical pipe 553 reflects the totally-reflected light emerging from the first optical pipe 553 to the second optical pipe 554. At this time, the rotating mirror 581 has been rotated to a position corresponding to the natural illumination mode or artificial illumination mode associated with the totally-reflected light The light reflected by the rotating mirror 581 is incident to the second optical pipe 554 via the incidence angle adjusting lens 582 of the second optical pipe 554. The incidence light travels along the second optical pipe 554 while being totally reflected by the optical total reflection film. During the travel thereof, the light in the second optical pipe 554 is transmitted through the second optical pipe 554, thereby illuminating the indoor space at a certain illumination level (lux).

Next, the ventilation mode of the ventilation/illumination system will be described.

When the ventilation device 510 is operated, indoor air is introduced into the air discharge guide 551 after being filtered while passing through a filter (not shown). The filtered indoor air is discharged to the outdoors via the air discharging diffuser 556.

Hereinafter, a ventilation/illumination system according to a sixth embodiment of the present invention will be described with reference to FIG. 16.

Figure 16:
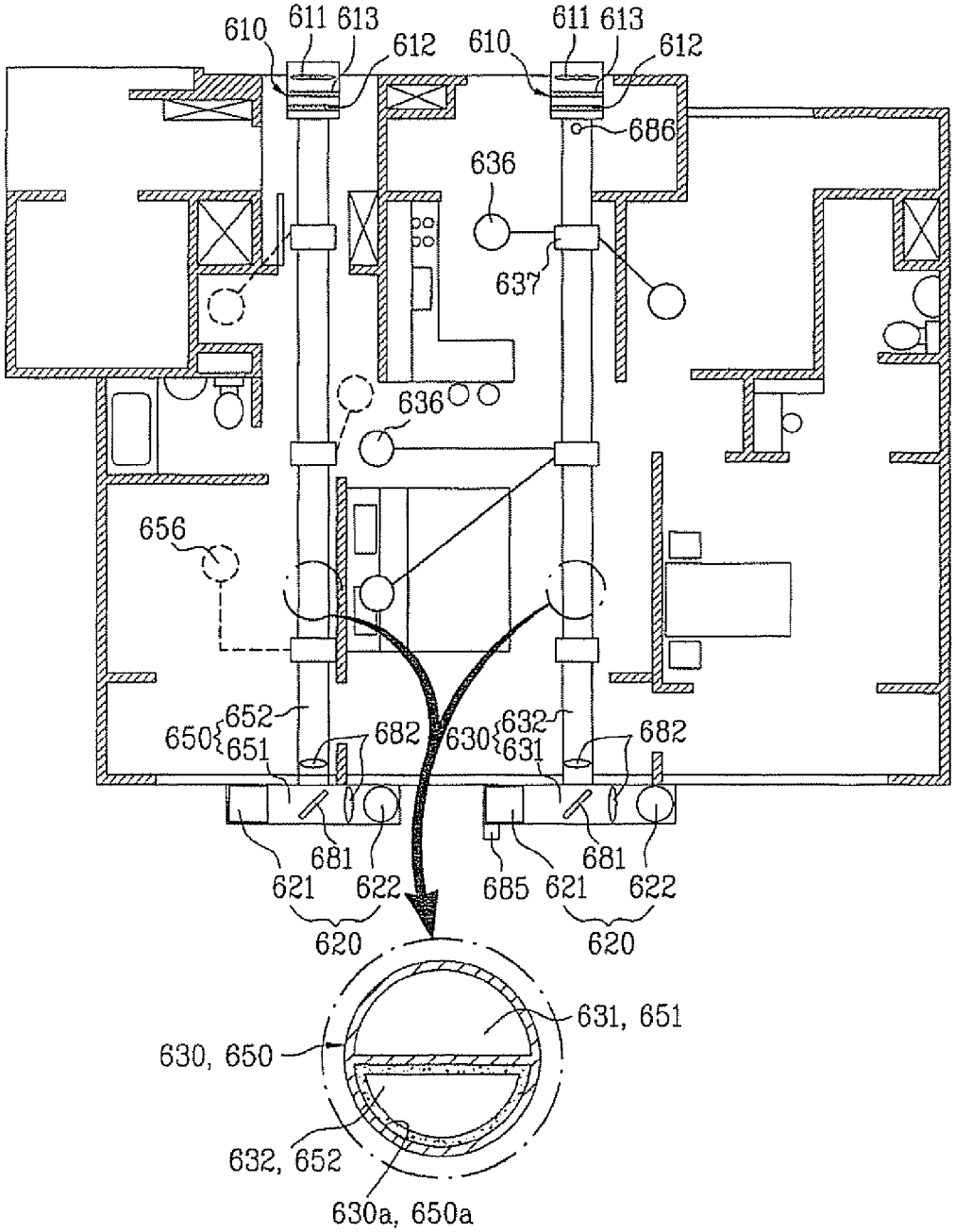
FIG. 16 is a schematic plan view illustrating a configuration of a ventilation/illumination system according to a sixth embodiment of the present invention.

As shown in FIG. 16, the ventilation/illumination system includes a ventilation device 610 for blowing outdoor air, a light supplying device 620 for supplying light, an illumination/air supply duct 630 in which an air supply passage and a light passage are defined such that they are independent of each other, and an illumination/air discharge duct 650 in which an air discharge passage and a light passage are defined such that they are independent of each other.

The illumination/air supply duct 630 includes an air supply guide 631 connected to the ventilation device 610, and adapted to guide outdoor air to an indoor space, and an air-supply-side light guide 632 formed such that the air-supply-side light guide 632 is independent of the air supply guide 631. The air-supply-side light guide 632 is connected to the light providing device 620, and is adapted to guide light therethrough while totally reflecting the light, to enable the light to illuminate the indoor space.

The illumination/air discharge duct 650 includes an air discharge guide 651 connected to the ventilation device 610, and adapted to guide indoor air to the outdoors, and an air-discharge-side light guide 652 formed such that the light guide 652 is independent of the air discharge guide 651. The air-discharge-side light guide 652 is connected to the light providing device 620, and is adapted to guide light therethrough while totally reflecting the light, to enable the light to illuminate the indoor space.

since the ventilation device 610 is substantially identical to that of the first embodiment associated with the ventilation/illumination system, no description thereof will be given. However, the air-supply-side and air-discharge-side light guides 632 and 652 are not connected to the ventilation device 610.

Air supplying diffusers 636 are connected to the air supply guide 631. Air discharging diffusers 656 are connected to the air discharge guide 651.

Preferably, a filter 612 is also arranged in the ventilation device 610, in order to filter outdoor air, and thus, to enable filtered air to be supplied to the air supply guide 631. Accordingly, it is possible to prevent a contaminant such as dust contained in outdoor air from being introduced into the indoor space.

Also, it will be appreciated that a deodorizing filter 613 may be installed in the ventilation device 610, to deodorize the outdoor air to be introduced into the indoor space.

Each of the illumination/air supply duct 630 and illumination/air discharge duct 650 may have a rectilinear structure, or may have a bent structure. Where the illumination/air supply or discharge duct 630 or 650 has a bent structure, it is preferred that mirrors (not shown) be arranged at bent portions of the illumination/air supply or discharge duct 630 or 650, in order to reflect light in desired directions, respectively.

The illumination/air supply or discharge duct 630 or 650 is constituted by two or more optical pipes, adjacent ones of which are connected by a connector 637.

A first embodiment of the light supplying device 620 will be described with reference to FIG. 16.

In the embodiment of FIG. 16, the light supplying device 620 includes sunlight concentrators 621 respectively arranged in the air-supply-side and air-discharge-side light guides 632 and 652, and adapted to supply concentrated sunlight, and artificial light generators 622 respectively arranged in the air-supply-side and air-discharge-side light guides 632 and 652, and adapted to supply artificial light.

It is preferred that each sunlight concentrator 621 be rotatable in accordance with the altitude of the sun, in order to efficiently concentrate sunlight to an associated one of the air-supply-side and air-discharge-side light guides 632 and 652.

Each sunlight concentrator 621 includes a light concentrating plate 621*a* for concentrating sunlight to the interior of an associated one of the air-supply-side and air-discharge-side light guides 632 and 652, and a motor 621*b* for rotating the light concentrating plate 621*a*. Although each light supplying device 620 is illustrated as including one sunlight concentrator 621 directed in one of the sunrise and sunset directions, sunlight concentrators 621 may be arranged to be directed in both the sunrise and sunset directions, respectively. In either case, each light supplying device 620 may include a plurality of sunlight concentrators 621.

Each artificial light generator 622 is constituted by a lamp adapted to generate artificial light, using a very high frequency (VHF) discharge since the artificial light generator 622 is substantially identical to that of the first embodiment of the ventilation/illumination system, no description thereof will be given.

Hereinafter, a second embodiment of the light supplying device will be described.

The second embodiment of the light supplying device is similar to that of FIG. 11. Accordingly, the second embodiment of the light supplying device will be described with reference to FIG. 11.

In this embodiment, the light supplying device includes a sunlight concentrator ("321" in FIG. 11) arranged in the air-supply-side light guide 632 (corresponding to "332" in FIG. 11), and adapted to supply concentrated sunlight, and an artificial light generator ("322" in FIG. 11) arranged in the air-discharge-side light guide 652 (corresponding to "352" in FIG. 11), and adapted to supply artificial light.

Next, a third embodiment of the light supplying device will be described.

The third embodiment of the light supplying device is similar to that of FIG. 12. Accordingly, the third embodiment of the light supplying device will be described with reference to FIG. 12.

In this embodiment, the light supplying device includes a sunlight concentrator ("321" in FIG. 12) arranged in the air-discharge-side light guide 652 (corresponding to "352" in FIG. 11), and adapted to supply concentrated sunlight, and an artificial light generator ("322" in FIG. 12) arranged in the air-supply-side light guide 632 (corresponding to "332" in FIG. 12), and adapted to supply artificial light.

Thus, a pair of sunlight concentrators and a pair of artificial light generators may be installed at the air-supply-side and air-discharge-side light guides 632 and 652, respectively, or one sunlight concentrator 621 and one artificial light generator 622 may be selectively installed at the air-supply-side and air-discharge-side light guides 632 and 652, respectively.

The air-supply-side light guide 632 includes a first optical pipe 633 connected to the light supplying device 620, and adapted to guide light therethrough while totally reflecting the light, and a second optical pipe 634 connected to the first optical pipe 633, and adapted to guide light therethrough while enabling the light to be irradiated to the indoor space. The air-discharge-side light guide 652 includes a first optical pipe 653 connected to the light supplying device, and adapted to guide light therethrough while totally reflecting the light, and a second optical pipe 654 connected to the first optical pipe 653, and adapted to guide light therethrough while enabling the light to be irradiated to the indoor space.

Preferably, each of the air supply guide 631 and air discharge guide 651 is arranged on only an associated one of the second optical pipes 634 and 654. In detail, each of the air supply guide 631 and air discharge guide 651 is formed integrally with the associated second optical pipe 634 or 654 such that the air supply guide 631 or air discharge guide 651 extends along the associated second optical pipe 634 or 654.

Each of the first optical pipes 633 and 653 is connected to one end of the associated second optical pipe 634 or 654. The ventilation device 610 is arranged at the other end of each of the second optical pipes 634 and 654.

The first optical pipes 633 and 653 may be arranged at the outdoors, or may be embedded in a wall of a building in which the ventilation/illumination system is installed.

Where the first optical pipes 633 and 653 are arranged at the outdoors, it is preferred that light in the first optical pipes 633 and 653 be prevented from being outwardly leaked from the first optical pipes 633 and 653. For example, when the first optical pipes 633 and 653 are made of acrylic resin allowing light to be transmitted therethrough, separate light shield ducts are arranged around the first optical pipes 633 and 653. Of course, the first optical pipes 633 and 653 may be made of a material preventing light from being transmitted therethrough. In this case, it is unnecessary to install separate light shield ducts around the first optical pipes 633 and 653.

Rotating mirrors 681 are arranged in the air-supply-side and air-discharge-side first optical pipes 633 and 653 at regions where the first optical pipes 633 and 653 are connected to the air-supply-side and air-discharge-side second optical pipes 634 and 654 such that the rotating mirrors 681 reflect light from the first optical pipes 633 and 653 to the second optical pipes 634 and 654, respectively. An incidence angle adjusting lens 682 is arranged in each of the first and second optical pipes 633, 634, 653, and 654, to adjust the incidence angle of light incident to an associated one of the first and second optical pipes 633, 634, 653, and 654.

Preferably, a first illuminance sensor 685 is arranged in at least one of the air-supply-side and air-discharge-side first optical pipes 633 and 653, in order to measure the illuminance of the sunlight or artificial light supplied to the air-supply-side first optical pipe 633 and/or air-discharge-side first optical pipe 653. The first illuminance sensor 685 measures the illuminance of the sunlight, and determines, based on the result of the measurement, which one of the associated sunlight concentrator 621 and artificial light generator 622 should be controlled.

The air supply guide 631 is separated from the air-supply-side light guide 632 by a barrier wall extending in a portion of the illumination/air supply duct 630 corresponding to the second optical pipe 634 in a longitudinal direction of the illumination/air supply duct 630 (as shown in FIG. 13) In this case, it is preferred that a portion of the air-supply-side light guide 632 corresponding to the second optical pipe 634 be exposed to the indoor space. An optical total reflection film 630*a* is attached to an inner surface of the air-supply-side light guide 632. Similarly, The air discharge guide 651 is separated from the air-discharge-side light guide 652 by a barrier wall extending in a portion of the illumination/air discharge duct 650 corresponding to the second optical pipe 654 in a longitudinal direction of the illumination/air discharge duct 650 (as shown in FIG. 13). In this case, it is preferred that a portion of the air-discharge-side light guide 652 corresponding to the second optical pipe 654 be exposed to the indoor space. An optical total reflection film 650*a* is attached to an inner surface of the air-discharge-side light guide 652.

The portions of the light guides 632 and 652 respectively corresponding to the second optical pipes 634 and 654 have a substantially semicircular cross-section. However, the light guides 632 and 652 are not limited to such a cross-section.

It is preferred that the air supply guide 631 and air discharge guide 651 be embedded in a ceiling of the inner space where the ventilation/illumination system is installed. In this case, it is also preferred that the air supply guide 631 and air discharge guide 651 be made of a flexible material. The air supplying diffusers 636 and 656 are connected to the air supply guide 631 and air discharge guide 651, respectively.

Each of the illumination/air supply duct and illumination/air discharge duct may have a double pipe structure (corresponding to "470" in FIG. 14) at a portion thereof corresponding to an associated one of the second optical pipes 634 and 654. That is, the double pipe structure of the illumination/air supply duct or illumination/air discharge duct forms an air supply guide or air discharge guide (corresponding to "471" in FIG. 14) and a light guide (corresponding to "472" in FIG. 14) such that the light guide is arranged around the air supply guide or air discharge guide. The light guide is arranged such that it is exposed to the indoor space. Optical total reflection films are attached to an inner surface of the light guide and an outer surface of the associated air supply guide or air discharge guide, respectively.

Support members (corresponding to "473" in FIG. 14) are interposed between each of the air supply guide and air discharge guide and the associated light guide. The support members support the associated air supply guide or air discharge guide such that the associated air supply guide or air discharge guide is maintained in a state of being uniformly spaced from the associated light guide.

Hereinafter, operation of the ventilation/illumination system having the above-described configuration according to the sixth embodiment of the present invention will be described. The following description will be given in conjunction with the first embodiment of the light supplying device.

The ventilation/illumination system can be operated in a natural illumination mode or in an artificial illumination mode in accordance with the illuminance of sunlight. Also, each illumination mode may be carried out simultaneously with or independently of a ventilation mode.

First, the illumination mode of the ventilation/illumination system will be described.

The ventilation/illumination system selectively operates the sunlight concentrator 621 or the artificial light generator 622, based on information as to the illuminance of sunlight sent from the first illuminance sensor 685. Of course, the sunlight concentrator 621 and artificial light generator 622 may be selectively operated in accordance with operation of the user.

When the sunlight concentrators 621 are operated, the sunlight concentrators 621 are first rotated, in accordance with the altitude of the sun, to an angular position where the sunlight concentrators 621 can concentrate a maximum amount of sunlight to the interior of the first optical pipes 633 and 653, respectively. On the other hand, when each artificial light generator 622 is operated, VHF artificial light is emitted from the artificial light generator 622.

The sunlight or artificial light is incident to the first optical pipes 633 and 653, and then travels along the first optical pipes 633 and 653 while being totally reflected.

The rotating mirror 681 in each of the first optical pipes 633 and 653 reflects the totally-reflected light emerging from the associated first optical pipe 633 or 653 to the associated second optical pipe 634 or 654. At this time, the rotating mirror 6B1 has been rotated to a position corresponding to the natural illumination mode or artificial illumination mode associated with the totally-reflected light. The light reflected by the rotating mirror 681 is incident to the associated second optical pipe 634 or 654 via the incidence angle adjusting lens 682 of the associated second optical pipe 634 or 654. The incidence light travels along the associated second optical pipe 634 or 654 while being totally reflected by the optical total reflection film. During the travel thereof, the light in each of the second optical pipes 634 and 654 is transmitted through the associated second optical pipe 634 or 654, thereby illuminating the indoor space at a certain illumination level (lux).

Since the indoor space is illuminated by both the optical pipes of the illumination/air supply duct and illumination/air discharge duct, as described above, it is possible to supply an increased amount of light to the indoor space.

Next, the ventilation mode of the ventilation/illumination system will be described.

When the ventilation device 610 is operated, outdoor air is introduced into the air supply guide 631 after being filtered while passing through the filters 612 and 613. The filtered outdoor air is discharged into the indoor space via the air supplying diffusers 636. Thus, the indoor space is ventilated by the outdoor air. On the other hand, indoor air is discharged to the outdoors via the air discharge guide 651. In this case, the ventilation device 610 does not function to cause air to flow through the light guides 632 and 652.

Hereinafter, a method for controlling the above-described ventilation/illumination system in accordance with the present invention will be described.

The control method includes the steps of selectively operating the sunlight concentrator or artificial light generator, to supply light, measuring the illuminance of the supplied light, measuring the illuminance of the light after the light is totally reflected in the illumination/air supply or discharge duct, calculating the difference between the illumination of the supplied light and the illumination of the totally-reflected light, and operating the cleaner when the calculated illumination difference is not less than a predetermined value, to clean the illumination/air supply or discharge duct.

It is preferred that the artificial light generator operate when the illuminance of the sunlight is not more than a predetermined value, Alternatively, the control method includes the steps of summing an operating time of the ventilation device, determining whether or not the summed operating time has reached a predetermined time, and cleaning the illumination/air supply or discharge duct when it is determined that the summed operating time has reached the predetermined time.

The above-described embodiments of the present invention have the following effects.

First, since a ventilation duct having an illumination function is implemented in accordance with the present invention, it is possible to not only ventilate an indoor space, but also to illuminate the indoor space, using a single duct. Accordingly, there are effects of a reduction in installation space and installation costs, and a simplified arrangement design.

Second, in accordance with the present invention, it is possible to illuminate an indoor space using sunlight, and thus, to greatly reduce the power consumption required to illuminate the indoor space.

Third, in accordance with the present invention, it is possible to greatly increase the degree of freedom associated with the installation of the ventilation/illumination duct, and thus, to greatly reduce loss of light and flow resistance of air.

Fourth, in accordance with the preset invention, it is possible to prevent foreign matter from being attached to the ventilation/illumination duct using a filter, and thus, to avoid a reduction in illumination efficiency.

Fifth, in accordance with the present invention, it is possible to clean the ventilation/illumination duct using a cleaner, and thus, to substantially recover the illuminance of the ventilation/illumination duct to an original level.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A ventilation/illumination system comprising:

a ventilation device that blows air from an outdoor space to an indoor space or from the indoor space to the outdoor space;

a light supplying device that supplies sunlight or artificial light in accordance with illumination of the sunlight including:

a sunlight concentrator adapted to supply concentrated sunlight; and an artificial light generator adapted to supply artificial light;

a ventilation/illumination duct that guides the air blown by the ventilation device to ventilate an indoor space through an inner surface thereof, and also to totally reflect the sunlight and/or artificial light supplied by the light supplying device to illuminate an indoor space by the inner surface thereof; and a cleaner arranged in the ventilation/illumination duct, the cleaner including a fan unit that discharges a contaminant from the ventilation/illumination duct to the outdoors, along with air, and a cleaning damper that opens or closes the end of the ventilation/illumination duct to clean the inner surface of the ventilation/illumination duct; and, a rotating mirror, arranged between the sunlight concentrator and the artificial light generator in the ventilation/illumination duct, and adapted to selectively reflect sunlight supplied by the sunlight concentrator and artificial light supplied by the artificial light generator by changing a reflection angle;

wherein the sunlight concentrator and the artificial light generator are arranged in the ventilation/illumination duct.

2. The ventilation/illumination system according to claim 1, wherein the ventilation/illumination duct includes at least one of an illumination/air discharge duct that discharges indoor air to the outdoors, and an illumination/air supply duct that guides outdoor air to the indoor space.

3. The ventilation/illumination system according to claim 2, wherein the ventilation device includes a filter that filters the outdoor air such that the ventilation device supplies the filtered air to the illumination/air supply duct.

4. The ventilation/illumination system according to claim 2, wherein the illumination/air supply duct includes:

a first air supply duct connected to the ventilation device, and adapted to guide the light and the outdoor air; and a second air supply duct connected to the first air supply duct, and arranged in the indoor space, the second air supply duct functioning to guide the light and the outdoor air such that the light and the outdoor air are supplied to the indoor space.

5. The ventilation/illumination system according to claim 4, wherein: the first air supply duct is made of a material allowing light to be transmitted through the first air supply duct; and the ventilation/illumination duct further includes a light shield duct arranged to surround the first air supply duct.

6. The ventilation/illumination system according to claim 4, wherein the first air supply duct is made of a material preventing light from being transmitted through the first air supply duct.

7. The ventilation/illumination system according to claim 4, wherein the second air supply duct has a rectilinear structure.

8. The ventilation/illumination system according to claim 4, wherein the second air supply duct has a bent structure.

9. The ventilation/illumination system according to claim 8, wherein the illumination/air supply duct further includes: mirrors arranged at bent portions of the second air supply duct, and adapted to reflect light.

10. The ventilation/illumination system according to claim 4, wherein the illumination/air supply duct further includes:

an incidence angle adjusting lenses respectively arranged in the first and second air supply ducts, and adapted to adjust an incidence angle of the light incident to the first air supply duct and an incidence angle of the light incident to the second air supply duct;

wherein the sunlight concentrator, the artificial light generator, and the rotating mirror are arranged in the first air supply duct.

11. The ventilation/illumination system according to claim 2, wherein the cleaner includes at least one of an air supply duct cleaner arranged in the illumination/air supply duct and an air discharge duct cleaner arranged in the illumination/air discharge duct.

12. The ventilation/illumination system according to claim 11, wherein the air supply duct cleaner is arranged at an end of the illumination/air supply duct.

13. The ventilation/illumination system according to claim 11, wherein the air discharge duct cleaner is arranged at an end of the illumination/air discharge duct.

14. The ventilation/illumination system according to claim 13, wherein the air discharge duct cleaner includes:

a fan unit for discharging a contaminant existing in the illumination/air discharge duct to the outdoors, along with air; and a cleaning damper for opening or closing the end of the illumination/air discharge duct.

15. The ventilation/illumination system according to claim 2, further comprising:

an luminance sensor arranged inside or outside the illumination/air supply duct, and adapted to measure an luminance of the supplied light.

16. The ventilation/illumination system according to claim 2, further comprising:

an air discharge duct connected to the ventilation device, and adapted to guide the indoor air to be discharged to the outdoors.

17. The ventilation/illumination system according to claim 2, wherein the illumination/air discharge duct includes:

a first air discharge duct connected to the ventilation device, and adapted to guide the light and to discharge the indoor air to the outdoors; and a second air discharge duct connected to the first air discharge duct, and arranged in the indoor space, the second air discharge duct functioning to discharge the indoor air into the first air discharge duct.

18. The ventilation/illumination system according to claim 17, wherein: the first air discharge duct is made of a material allowing light to be transmitted through the first air discharge duct; and the ventilation/illumination duct further includes a light shield duct arranged to surround the first air discharge duct.

19. The ventilation/illumination system according to claim 17, wherein the first air discharge duct is made of a material preventing light from being transmitted through the first air discharge duct.

20. The ventilation/illumination system according to claim 17, wherein the second air discharge duct has a rectilinear structure.

21. The ventilation/illumination system according to claim 17, wherein the second air discharge duct has a bent structure.

22. The ventilation/illumination system according to claim 21, wherein the illumination/air discharge duct further includes: mirrors arranged at bent portions of the second air discharge duct, and adapted to reflect light.

23. The ventilation/illumination system according to claim 17, wherein the illumination/air discharge duct further includes:

a rotating mirror arranged in the first air discharge duct, and adapted to reflect light from the first air discharge duct to the second air discharge duct; and incidence angle adjusting lenses respectively arranged in the first and second air discharge ducts, and adapted to adjust an incidence angle of the light incident to the first air discharge duct and an incidence angle of the light incident to the second air discharge duct.

24. The ventilation/illumination system according to claim 2, wherein the illumination/air discharge duct includes a filter for filtering the indoor air such that the indoor air is introduced into the illumination/air discharge duct after being filtered.

25. The ventilation/illumination system according to claim 2, further comprising:

an illuminance sensor arranged inside or outside the illumination/air discharge duct, and adapted to measure an illuminance of the supplied light.

26. The ventilation/illumination system according to claim 2, wherein the light supplying device includes: a sunlight concentrator arranged in the illumination/air discharge duct, and adapted to supply concentrated sunlight; and an artificial light generator arranged in the illumination/air discharge duct, and adapted to supply artificial light.

27. The ventilation/illumination system according to claim 26, wherein the sunlight concentrator is rotatable in accordance with an altitude of the sun, to concentrate sunlight on the illumination/air discharge duct.

28. The ventilation/illumination system according to claim 2, further comprising:

an air supply duct connected to the ventilation device, and adapted to guide the outdoor air to be supplied to the indoor space.

29. The ventilation/illumination system according to claim 1, wherein the sunlight concentrator is rotatable in accordance with an altitude of the sun, to concentrate sunlight on the illumination/air supply duct.

* * * * *